US006543761B2

(12) United States Patent
Endo

(10) Patent No.: US 6,543,761 B2
(45) Date of Patent: Apr. 8, 2003

(54) SHEET FEEDING DEVICE FOR AN IMAGE FORMING APPARATUS

(75) Inventor: Kenji Endo, Shibata-gun (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/988,212

(22) Filed: Nov. 19, 2001

(65) Prior Publication Data

US 2002/0060397 A1 May 23, 2002

Related U.S. Application Data

(62) Division of application No. 09/492,272, filed on Jan. 27, 2000.

(30) Foreign Application Priority Data

Feb. 26, 1999 (JP) ..... 11-51542

(51) Int. Cl.[7] ..... B65H 7/08

(52) U.S. Cl. ..... 271/110; 271/111; 271/117; 271/124; 271/167; 271/171

(58) Field of Search ..... 271/110, 111, 271/117, 124, 167, 171

(56) References Cited

U.S. PATENT DOCUMENTS 5,927,703 A 7/1999 Endo
6,065,397 A 5/2000 Sato
6,213,015 B1 4/2001 Sato et al.
6,276,679 B1 * 8/2001 Joyce et al. ..... 271/122
6,328,301 B1 * 12/2001 Tsujii et al. ..... 271/117
6,331,101 B2 * 12/2001 Leu et al. ..... 417/423.14

FOREIGN PATENT DOCUMENTS

JP 60-56746 * 4/1985 ..... B65H/3/06

* cited by examiner

*Primary Examiner*—Donald P. Walsh
*Assistant Examiner*—Kenneth W Bower
(74) *Attorney, Agent, or Firm*—Oblon, Spivak, McClelland, Maier & Neustadt, P.C.

(57) ABSTRACT

A sheet feeding device for an image forming apparatus includes a plurality of separator pads each having a particular coefficient of friction with respect to sheets for separating the sheets one by one. An automatic switching mechanism automatically replaces the separator pads. The automatic switching mechanism includes a pad pressure switching section, a pad angle switching section, a ball screw with a worm wheel mounted thereon, a ball nut meshing with the ball screw, a worm meshing with the worm wheel for moving a movable member in the widthwise direction of the sheets via the ball screw, a pad motor for causing the worm to rotate, and a sensor responsive to the position of the movable member. The device automatically selects one of the separator pads and an angle thereof in order to set up optimal sheet feed conditions matching with environmental conditions including temperature and humidity.

8 Claims, 14 Drawing Sheets

Fig.12

| Fig.12A |
|---|
| Fig.12B |

Fig. 12A

| KIND OF SHEET | TEMPERA-TURE (℃) | HUMIDITY (RH%) | PAD | PAD ANGLE | FEED PRES-SURE | SEPA-RATION | JUMP BOARD ANGLE | AMOUNT OF LOOP | APPLICATIONS |
|---|---|---|---|---|---|---|---|---|---|
| STANDARD | 15°OR BELOW | 40% OR BELOW | STANDARD | 22° | 4 | 3 | UP | 30 | HIGH QUALITY, MEDIUM & RECYCLED SHEETS |
| | 15°OR BELOW | 41% OR ABOVE | STANDARD | 22° | 3 | 3 | UP | 30 | |
| | 16~25° | 50% OR BELOW | STANDARD | 22° | 4 | 2 | UP | 28 | |
| | 16~25° | 51% OR ABOVE | STANDARD | 22° | 3 | 2 | UP | 28 | |
| | 26°OR ABOVE | 60% OR BELOW | STANDARD | 20° | 4 | 2 | UP | 25 | |
| | 26°OR ABOVE | 61% OR ABOVE | STANDARD | 20° | 3 | 2 | UP | 25 | |
| ROUGH | 15°OR BELOW | 40% OR BELOW | STANDARD | 20° | 4 | 2 | UP | 28 | ROUGH SHEETS |
| | 15°OR BELOW | 41% OR ABOVE | STANDARD | 20° | 3 | 2 | UP | 28 | |
| | 16~25° | 50% OR BELOW | STANDARD | 20° | 3 | 2 | UP | 25 | |
| | 16~25° | 51% OR ABOVE | STANDARD | 22° | 2 | 2 | UP | 25 | |
| | 26°OR ABOVE | 60% OR BELOW | STANDARD | 20° | 2 | 1 | UP | 25 | |
| | 26°OR ABOVE | 61% OR ABOVE | STANDARD | 20° | 1 | 1 | UP | 25 | |

Fig. 12B

| | | | | | | | | | |
|---|---|---|---|---|---|---|---|---|---|
| THIN | 15°OR BELOW | 40% OR BELOW | SPECIAL | 20° | 2 | 2 | UP | 23 | THIN SHEETS & NOSHIGAMI |
| | 15°OR BELOW | 41% OR ABOVE | SPECIAL | 20° | 1 | 2 | UP | 23 | |
| | 16~25° | 50% OR BELOW | SPECIAL | 18° | 2 | 2 | UP | 21 | |
| | 16~25° | 51% OR ABOVE | SPECIAL | 18° | 1 | 2 | UP | 21 | |
| | 26°OR ABOVE | 60% OR BELOW | SPECIAL | 18° | 1 | 1 | UP | 21 | |
| | 26°OR ABOVE | 61% OR ABOVE | SPECIAL | 18° | 0 | 1 | UP | 21 | |
| THICK | 15°OR BELOW | 40% OR BELOW | SPECIAL | 20° | 6 | 2 | DOWN | 23 | HIGH QUALITY 135 KG SHEETS OR ABOVE, DRAWING PAPER & POSTCARDS |
| | 15°OR BELOW | 41% OR ABOVE | SPECIAL | 20° | 5 | 2 | DOWN | 23 | |
| | 16~25° | 50% OR BELOW | SPECIAL | 18° | 4 | 1 | DOWN | 21 | |
| | 16~25° | 51% OR ABOVE | SPECIAL | 18° | 3 | 1 | DOWN | 21 | |
| | 26°OR ABOVE | 60% OR BELOW | SPECIAL | 18° | 3 | 0 | DOWN | 21 | |
| | 26°OR ABOVE | 61% OR ABOVE | SPECIAL | 18° | 2 | 0 | DOWN | 21 | |
| SPECIAL | 15°OR BELOW | 40% OR BELOW | SPECIAL | 20° | 3 | 1 | DOWN | 23 | ENVELOPES (e.g. RECTANGULAR) |
| | 15°OR BELOW | 41% OR ABOVE | SPECIAL | 20° | 2 | 1 | DOWN | 23 | |
| | 16~25° | 50% OR BELOW | SPECIAL | 18° | 2 | 1 | DOWN | 21 | |
| | 16~25° | 51% OR ABOVE | SPECIAL | 18° | 2 | 1 | DOWN | 21 | |
| | 26°OR ABOVE | 60% OR BELOW | SPECIAL | 18° | 1 | 0 | DOWN | 21 | |
| | 26°OR ABOVE | 61% OR ABOVE | SPECIAL | 18° | 1 | 0 | DOWN | 21 | |

Fig.15

Fig.15A

Fig.15B

Fig. 15A

| KIND OF SHEET | TEMPERA-TURE (℃) | HUMIDITY (RH%) | PAD | PAD ANGLE | FEED PRES-SURE | SEPA-RATION | JUMP BOARD ANGLE | SHEET CLAMP | AMOUNT OF LOOP | APPLI-CATIONS |
|---|---|---|---|---|---|---|---|---|---|---|
| STANDARD | 15°OR BELOW | 40% OR BELOW | STANDARD | 22° | 4 | 3 | UP | YES | 30 | HIGH QUALITY, MEDIUM & RECYCLED SHEETS |
| | 15°OR BELOW | 41% OR ABOVE | STANDARD | 22° | 3 | 3 | UP | YES | 30 | |
| | 16~25° | 50% OR BELOW | STANDARD | 22° | 4 | 2 | UP | YES | 28 | |
| | 16~25° | 51% OR ABOVE | STANDARD | 22° | 3 | 2 | UP | YES | 28 | |
| | 26°OR ABOVE | 60% OR BELOW | STANDARD | 20° | 4 | 2 | UP | YES | 25 | |
| | 26°OR ABOVE | 61% OR ABOVE | STANDARD | 20° | 3 | 2 | UP | YES | 25 | |
| ROUGH | 15°OR BELOW | 40% OR BELOW | STANDARD | 20° | 4 | 2 | UP | YES | 28 | ROUGH SHEETS |
| | 15°OR BELOW | 41% OR ABOVE | STANDARD | 20° | 3 | 2 | UP | YES | 28 | |
| | 16~25° | 50% OR BELOW | STANDARD | 20° | 3 | 2 | UP | YES | 25 | |
| | 16~25° | 51% OR ABOVE | STANDARD | 20° | 2 | 2 | UP | YES | 25 | |
| | 26°OR ABOVE | 60% OR BELOW | STANDARD | 20° | 2 | 1 | UP | YES | 25 | |
| | 26°OR ABOVE | 61% OR ABOVE | STANDARD | 20° | 1 | 1 | UP | YES | 25 | |

Fig. 15B

| | | | | | | | | | | |
|---|---|---|---|---|---|---|---|---|---|---|
| THIN | 15°OR BELOW | 40% OR BELOW | SPECIAL | 20° | 2 | 2 | UP | YES | 23 | THIN SHEETS & NOSHI-GAMI |
| | 15°OR BELOW | 41% OR ABOVE | SPECIAL | 20° | 1 | 2 | UP | YES | 23 | |
| | 16~25° | 50% OR BELOW | SPECIAL | 18° | 2 | 2 | UP | YES | 21 | |
| | 16~25° | 51% OR ABOVE | SPECIAL | 18° | 1 | 2 | UP | YES | 21 | |
| | 26°OR ABOVE | 60% OR BELOW | SPECIAL | 18° | 1 | 1 | UP | YES | 21 | |
| | 26°OR ABOVE | 61% OR ABOVE | SPECIAL | 18° | 0 | 1 | UP | YES | 21 | |
| THICK | 15°OR BELOW | 40% OR BELOW | SPECIAL | 20° | 6 | 2 | DOWN | NO | 23 | HIGH QUALITY 135 KG SHEETS OR ABOVE, DRAWING PAPER & POST-CARDS |
| | 15°OR BELOW | 41% OR ABOVE | SPECIAL | 20° | 5 | 2 | DOWN | NO | 23 | |
| | 16~25° | 50% OR BELOW | SPECIAL | 18° | 4 | 1 | DOWN | NO | 21 | |
| | 16~25° | 51% OR ABOVE | SPECIAL | 18° | 3 | 1 | DOWN | NO | 21 | |
| | 26°OR ABOVE | 60% OR BELOW | SPECIAL | 18° | 3 | 0 | DOWN | NO | 21 | |
| | 26°OR ABOVE | 61% OR ABOVE | SPECIAL | 18° | 2 | 0 | DOWN | NO | 21 | |
| SPECIAL | 15°OR BELOW | 40% OR BELOW | SPECIAL | 20° | 3 | 1 | DOWN | NO | 23 | ENVE-LOPES (e.g.RECT-ANGULAR) |
| | 15°OR BELOW | 41% OR ABOVE | SPECIAL | 20° | 2 | 1 | DOWN | NO | 23 | |
| | 16~25° | 50% OR BELOW | SPECIAL | 18° | 2 | 1 | DOWN | NO | 21 | |
| | 16~25° | 51% OR ABOVE | SPECIAL | 18° | 2 | 1 | DOWN | NO | 21 | |
| | 26°OR ABOVE | 60% OR BELOW | SPECIAL | 18° | 1 | 0 | DOWN | NO | 21 | |
| | 26°OR ABOVE | 61% OR ABOVE | SPECIAL | 18° | 1 | 0 | DOWN | NO | 21 | |

SHEET FEEDING DEVICE FOR AN IMAGE FORMING APPARATUS

CROSS-REFERENCE TO RELATED APPLICATION

This application is a divisional application of, and claims priority to, Ser. No. 09/492,272 filed Jan. 27, 2000 and claims priority to Japanese Application No. JP 1151542 filed Feb. 26, 1999. The entire contents of the parent application and the Japanese application are hereby incorporated herein by reference.

BACKGROUND OF THE INVENTION

The present invention relates to a sheet feeding device for an image forming apparatus and more particularly to a sheet feeding device built in or operatively connected to a printer, copier or similar image forming apparatus.

A stencil printer belonging to a family of printers includes a print drum around which a master is wrapped. A press roller, press drum or similar pressing means presses a sheet fed from a sheet feeding device at a preselected timing against the master. As a result, ink is transferred from the inside of the print drum to the sheet via the perforations of the master, forming an ink image on the sheet. In a copier, for example, a toner image is transferred from an image carrier to a sheet fed from a sheet feeding device at a preselected timing.

The sheet feeding device is built in or operatively connected to the image forming apparatus and includes a tray or a cassette loaded with a stack of sheets. A pickup roller contacts the top sheet and pays it out. A separator pad or separating member and a separator roller cooperate to separate the top sheet being paid out by the pickup roller from the underlying sheets. This kind of sheet separation, generally referred to as a friction separation system, causes a greater frictional force to act between the separator pad and the sheets than between the sheets.

A stencil printer, among others, is operated with various kinds of sheets. Sheets are generally classified into standard sheets, thin sheets and thick sheets or more minutely into standard sheets, rough sheets, thin sheets, thick sheets, and special sheets. As for the minute classification, standard sheets include high quality sheets (high quality 55 kg sheets, high quality sheets for stencil printers and so forth), medium quality sheets, and recycled sheets. Thin sheets include thin Noshigami (a piece of paper customarily attached to a gift in Japan) and high quality 45 kg sheets. Thick sheets include high quality 135 kg sheets or above, drawing paper, and postcards. Special sheets include rectangular envelopes.

Sheets of each kind or each size have particular quality including thickness and surface condition and a particular weight. Therefore, the frictional force depends on the kind and size of sheets and sometimes renders sheet separating conditions in adequate. This is apt to cause a plurality of sheets to be fed at the same time (over lap feed hereinafter) or cause no sheets to be fed (feed failure hereinafter) or cause thick sheets to peel off, proving that the optimal sheet feed conditions including a feed pressure and a separation pressure depend on the kind and size of sheets.

As for a stencil printer operable with various kinds of sheets, as stated above, it is difficult to optimize sheet feed conditions for all kinds of sheets by simply adjusting the feed pressure, separation pressure and so forth stepwise with a single separator pad or a single pad angle.

Generally, the sheet feed conditions become inadequate and bring about defective sheet feed, depending also on temperature, humidity and other environmental conditions. For example, when temperature or humidity drops, the overlap feed is apt to occur. In light of this, a high separation pressure and a low feed pressure are selected. When temperature or humidity high, a low separation pressure and a high feed pressure are selected because the feed failure is apt to occur.

On the other hand, for a given separation pressure, the frictional force to act and therefore the sheet feeding ability depends on the material and surface condition of the separator pad. It is therefore a common practice to classify sheets by kind and size and prepare a plurality of different separator pads each matching with a particular class of sheets as determined by experiments. An optimal separator pad is selected in accordance with the kind and size of sheets to be used.

However, in most of conventional sheet feeding devices, the materials of the separator pads and pad angles are fixed and cannot be switched. As a result, when the sheet feeding device is frequently operated, i.e., when a great number of sheets are fed, the separator pads must be frequently replaced due to wear. The kind of the separator pad and pad angle, if switchable, are switched by hand. Manual switching operation is not easy and is therefore extremely troublesome to perform.

The above problems with the conventional sheet feeding devices may be summarized, as follows.

(1) The kind of the separator pad and pad angle which cannot be automatically switched are troublesome to replace. It is therefore impractical to set up optimal sheet feed conditions matching with the kind of sheets to be used or temperature, humidity and other environmental conditions, resulting in jams, overlap feed, peeling and other defective sheet feed.

(2) The kind of the separator pad and pad angle, if switchable, cannot be easily switched. This, coupled with the fact that the switching operation relies on the operator's experiences, makes it difficult to select optimal sheet feed conditions. Further, although the kind of the separator pad and pad angle may be variable in accordance with the kind and size of sheets, the operation for varying the sheet feed conditions is extremely troublesome and delicate to perform. As a result, printing, for example, is often executed without the optimization of the sheet feed conditions, again resulting in defective sheet feed. This prevents merits achievable with the switching of the kind of the separator pad and pad angle from being made most of.

(3) When spare pads are not available at the time for replacing the separator pad in use, a long period of time is necessary for replacement, or the apparatus is killed over a long period of time to simply wait for the delivery of spare pads.

Technologies relating to the present invention are disclosed in, e.g., Japanese Patent Laid-Open Publication Nos. 5-229243, 930714, 9-235033, 7-125855, 8-108947, 8-301500, 9-86692, 9-208058 and 10-139191, U.S. Pat. No. 5,927,703, and U.S. patent application Ser. Nos. 08/925,648, 09/222,820, and 09/135,856.

SUMMARY OF THE INVENTION

It is therefore an object of the present invention to provide a sheet feeding device for an image forming apparatus capable of automatically switching the kind of a separator pad and/or a pad angle without any troublesome manual operation.

It is another object of the present invention to provide a sheet feeding device for an image forming apparatus capable of automatically switching a separating member and/or the angle of the separating member in accordance with the kind of sheets to be used and temperature, humidity and other environmental conditions.

It is still another object of the present invention to provide a sheet feeding device for an image forming apparatus capable of automatically selecting and setting optimal sheet feed conditions matching with the kind of a separating member and/or the angle of the separating member automatically selected, thereby guaranteeing optimal sheet feed conditions at all times.

It is a further object of the present invention to provide a sheet feeding device for an image forming apparatus obviating an occurrence that a long period of time is wasted for replacement due to the absence of spare pads or that the apparatus is killed over a long period of time due to the absence of spare pads.

In accordance with the present invention, a sheet feeding device for an image forming apparatus includes a plurality of separating members each having a particular coefficient of friction with respect to a sheet for separating sheets one by one, and an automatic separating member switching mechanism for automatically selecting one of the separating members.

Also, in accordance with the present invention, a sheet feeding device for an image forming apparatus includes a plurality of separating members for separating sheets one by one, and an automatic separation angle switching mechanism for automatically switching an angle of the separating members.

Further, in accordance with the present invention, a sheet feeding device for an image forming apparatus includes a plurality of separating members having the same coefficient of friction with respect to sheets for separating the sheets one by one, an automatic separating member switching mechanism including a drive source for automatically replacing the separating members, a counter for counting the sheets fed, and a controller for so controlling, when the counter counts a preselected number of sheets, the drive source as to automatically replace one separating member in use with another separating member.

BRIEF DESCRIPTION OF THE DRAWINGS

The above and other objects, features and advantages of the present invention will become more apparent from the following detailed description taken with the accompanying drawings in which:

FIG. 12 is a table listing specific sheet feed conditions unique to the illustrative embodiment;

FIG. 15 is a table listing specific sheet feed conditions unique to the alternative embodiment.

DESCRIPTION OF THE PREFERRED EMBODIMENTS

Preferred embodiments of the sheet feeding device in accordance with the present invention will be described hereinafter. An image forming apparatus to which the illustrative embodiments are applied is implemented as a stencil printer by way of example. It is to be noted that a term "sheet feed conditions" to appear repeatedly hereinafter include not only conditions for conveying a sheet toward an image forming section (including a printing section) but also conditions for conveying it away from the image forming section after image formation.

Figure 1:
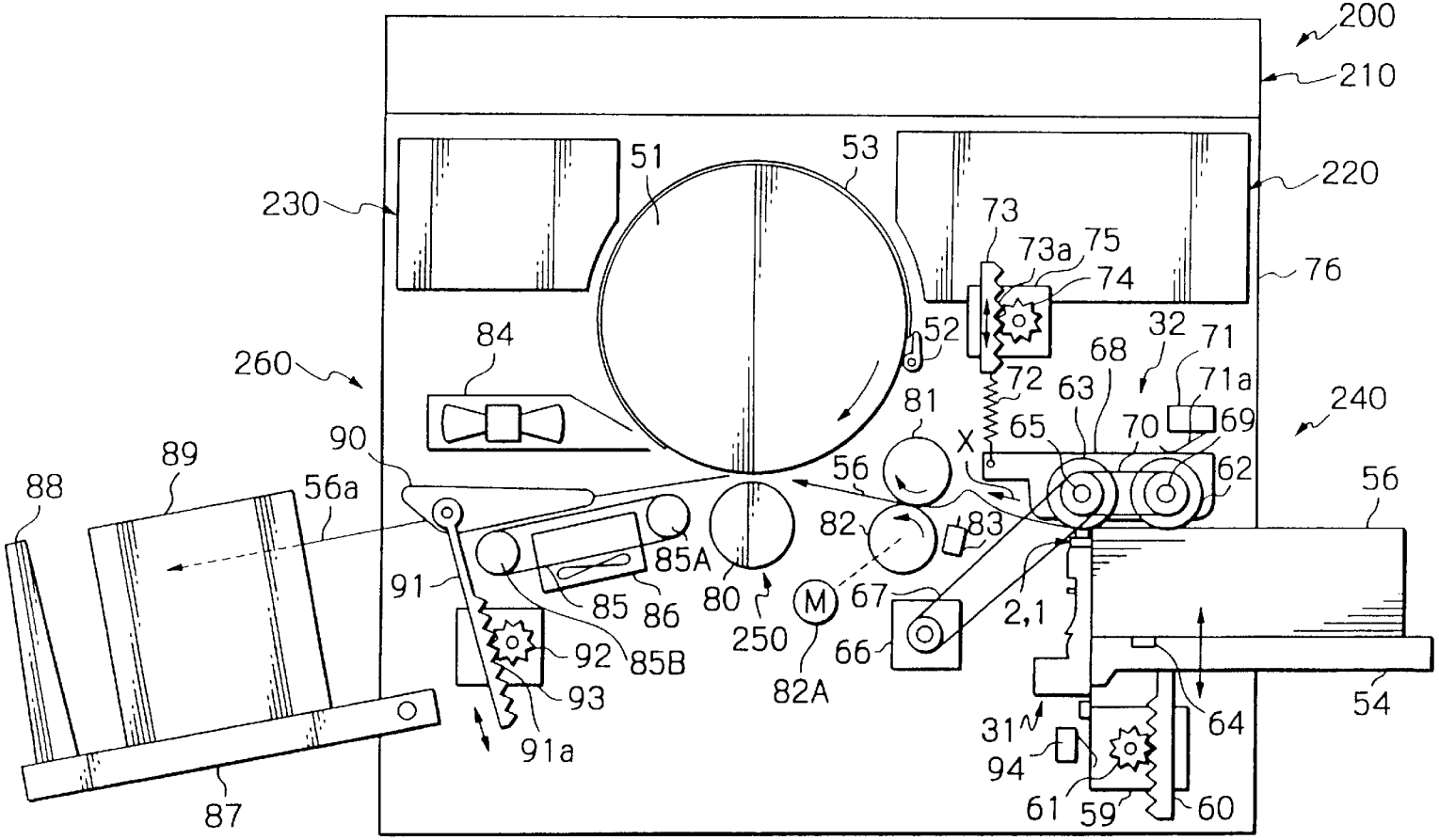
FIG. 1 is a front view showing a stencil printer to which a sheet feeding device embodying the present invention is applied.

Referring to FIG. 1 of the drawings, a stencil printer, generally 200, includes a cylindrical, porous print drum 51 for wrapping a master or cut stencil 53 therearound. A master discharging section 230 is located at the left-hand side of the print drum 51, as viewed in FIG. 1, for peeling off the used master 53 wrapped around the drum 51 and storing it. A master making section 220 is located at the right-hand side of the print drum 51, as viewed in FIG. 1, for making the master 53 while conveying it. A document scanning section 210 is positioned above the master discharging section 230, print drum 51 and master making section 220 for reading a document. An ink feeding device, not shown, is arranged in the print drum 51 for feeding ink to the master 53 wrapped around the drum 51. A press roller or pressing means 80 is positioned below the print drum 51 for pressing a sheet 56 against the print drum 51. A sheet feeding section 240 is located at the right-hand side of the press roller 80, as viewed in FIG. 1, and includes a sheet feeding device embodying the present invention for feeding the sheet 56 toward a print position between the print drum 51 and the press roller 80. A sheet discharging section 260 is located at the left-hand side of the print drum 51 and press roller 80, as viewed in FIG. 1. The print drum 51, ink feeding device and press roller 80 constitute a printing section 250.

Figure 8:
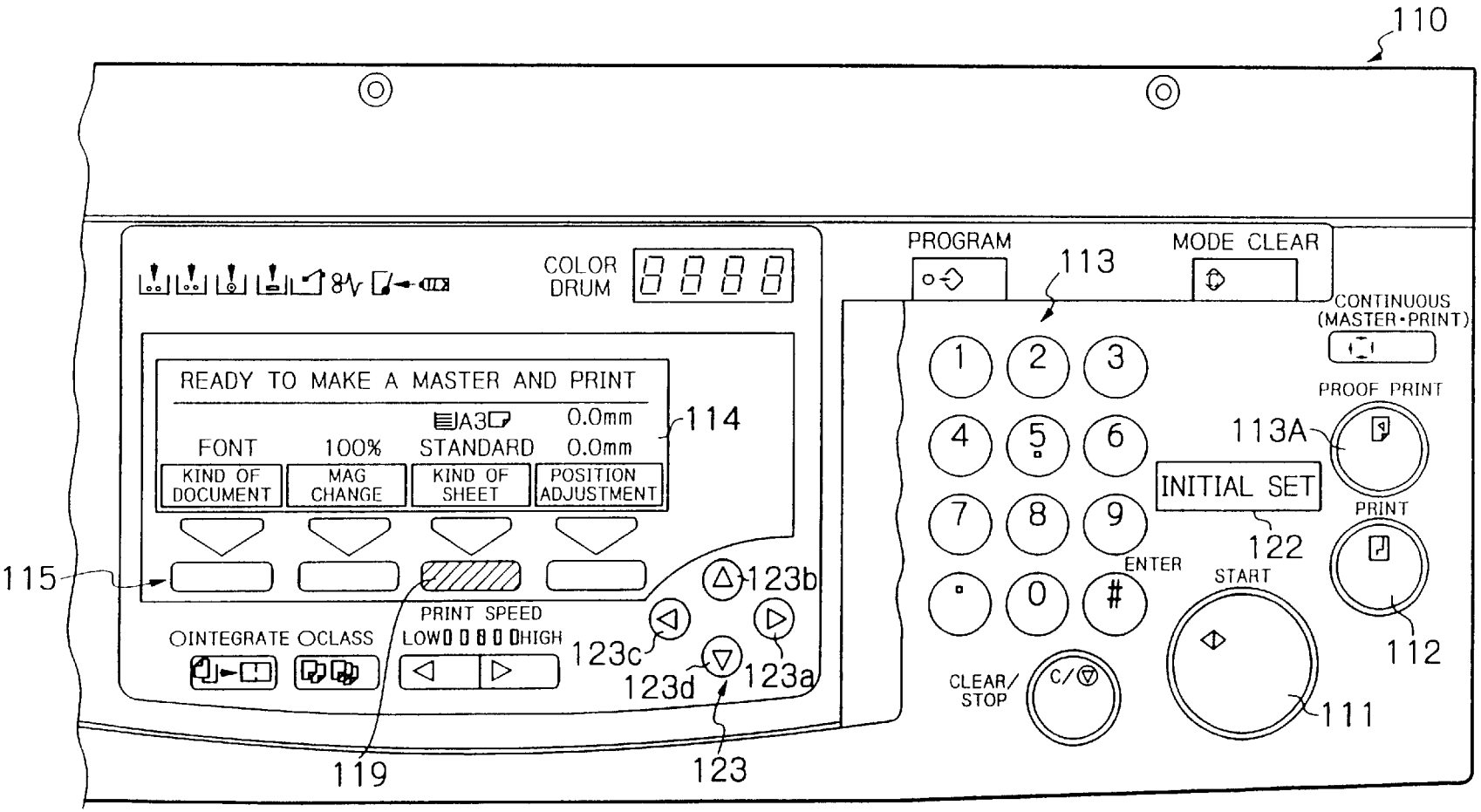
FIG. 8 is a fragmentary plan view showing an operation panel included in the stencil printer.

The sheet discharging section 230, master making section 220 and document scanning section 210 may be arranged as shown in, e.g., FIG. 8 of previously mentioned Laid-Open Publication No. 5-229243 and will not be described specifically.

A damper 52 is positioned on part of the outer periphery of the print drum 51 for clamping the leading edge of the master 53 fed from the master making section 220. When the print drum 51 is rotated in a direction indicated by an arrow in FIG. 1, the master 53 clamped by the damper 52 is sequentially wrapped around the drum 51.

Figure 7:
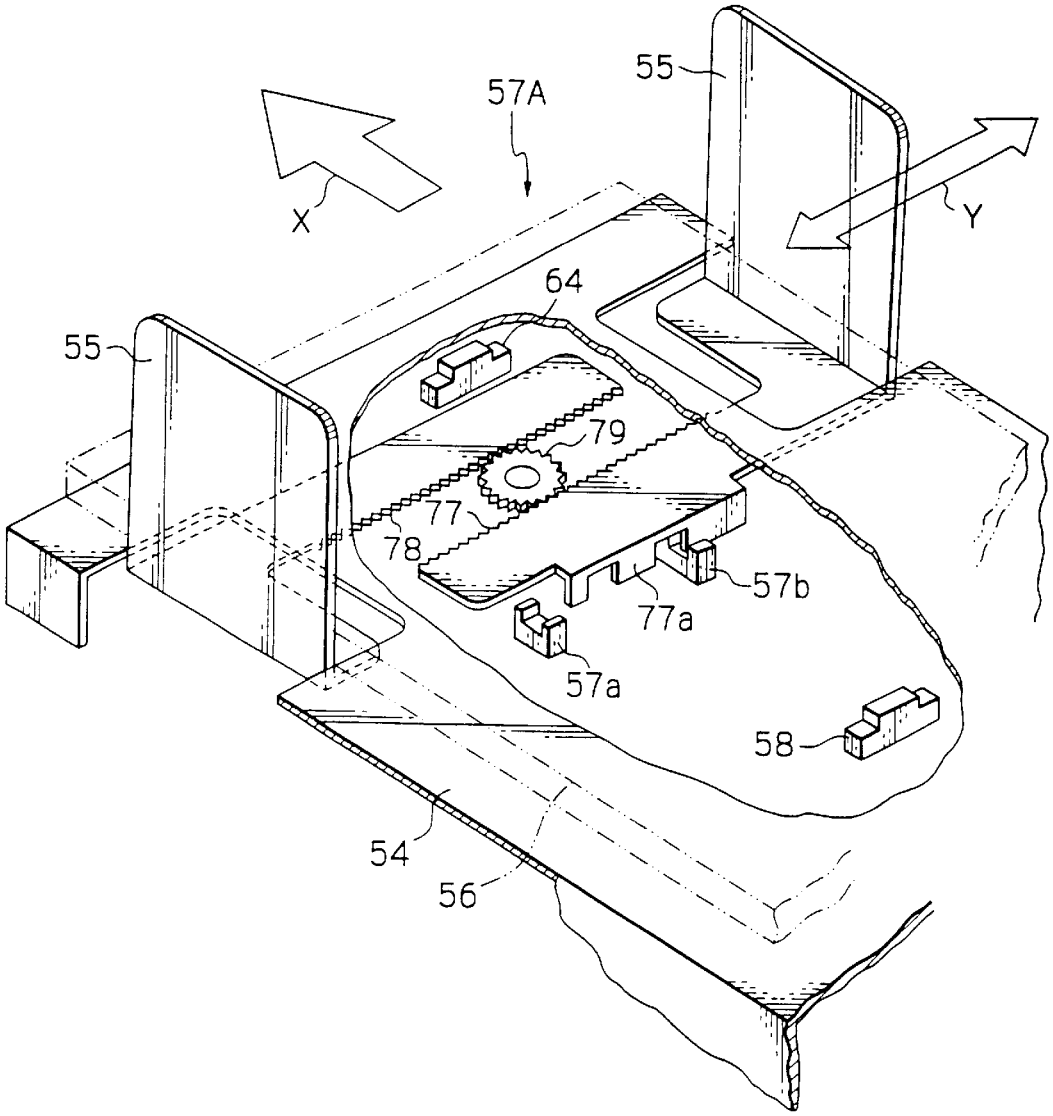
FIG. 7 is a partly taken away isometric view showing a sheet size sensing mechanism included in the illustrative embodiment together with a tray.

The sheet feeding section 240 includes a tray 54, a pickup roller portion 32, a separating portion 31, and a pair of registration rollers 81 and 82. The tray 54 is loaded with a stack of sheets 56 and movable up and down. As shown in FIG. 7, a pair of side fences 55 are mounted on the tray 54 and movable toward and away from each other in a direction Y perpendicular to a direction X in which the sheets 56 are fed from the tray 54. The direction Y is the widthwise direction of the sheets 56. The side fences 55 are interlocked to each other and used to position the widthwise edges of the sheets 56 in accordance with the sheet size.

A sheet size sensing mechanism is arranged on the bottom of the tray 54 and includes sheet size sensing means responsive to the size of the sheets 56. The sheet size sensing mechanism determines the size of the sheets 56 in interlocked relation to the movement of the side fences 55 in the direction Y. Specifically, as shown in FIG. 7, the sheet size sensing mechanism includes the side fences 55, a pinion 79, racks 78 and 77, a screen 77*a*, and size sensors 57*a*, 57*b* and 58. The pinion 79 is rotatably mounted on a stationary member positioned on the underside of the tray 54. The rack 78 is formed at the edge of the lower portion of the left side fence 55, as viewed in FIG. 7. The rack 77 is formed at the edge of the lower portion of the right side fence 55, as viewed in FIG. 7. The racks 78 and 77 are held in mesh with the pinion 79 while facing each other. The screen 77*a* protrudes downward from the lower portion of the right side fence 55 and includes a plurality of notches spaced from each other by a suitable distance. The size sensors 57*a* and 57*b* are affixed to the above stationary member at a suitable distance from each other. The screen 77*a* selectively meets the size sensors 57*a* and 57*b*. The size sensor 58 is also affixed to the stationary member and spaced by a suitable distance in the direction X.

The size sensors 57*a* and 57*b* each are a transmission type optical sensors made up of a light emitting portion and a light receiving portion. The size sensors 57*a* and 57*b* determine the size of the sheets 56 in the direction Y when the screen 77*a* selectively obstruct their optical paths. The size sensor 58 is a reflection type optical sensor made up of a light emitting portion and a light receiving portion and senses the size of the sheets 56 in the direction X. The size sensors 57*a*, 57*b* and 58 constitute a size sensor group 57A playing the role of the sheet size sensing means. A CPU (Central Processing Unit), which will be described later, combines data output from the size sensor group 57A to thereby determine the size of the sheets 56.

For details of the above sheet size sensing system, reference may be made to previously mentioned Laid-Open Publication No. 9-30714 by way of example. Of course, such a sheet size sensing system is only illustrative. While the sheet size sensing mechanism has been shown and described as including only a limited number of sensors for the simplicity of description, additional sensors may advantageously be used to automatically sense even postcards, envelopes and legal size sheets. This is particularly true with a stencil printer using various kinds of sheets, as stated earlier.

As shown in FIGS. 1 and 7, a sheet sensor for determining whether or not the sheets 56 are present is mounted on the stationary member of the tray 54 and implemented by a reflection type optical sensor.

A tray motor 59 causes the tray 54 to move up and down along guide means, not shown, via a pinion 61 and a rack 60 meshing with the pinion 61. The pinion 61 is affixed to the output shaft of the tray motor 59. The motor 59 may be implemented by a stepping motor by way of example.

The pickup roller portion 32 positioned above the tray 54 includes a pickup roller or sheet feeding means 62, a separator roller 63, and a feed pressure adjusting mechanism. The pickup roller 62 sequentially pays out the sheets 56 stacked on the tray 54, the top sheet being first. The separator roller 63 cooperates with either one of separator pads 1 and 2, which will be described, to separate the top sheet 56 from the underlying sheets 56. The feed pressure adjusting mechanism adjusts a feed pressure to act on the sheet 56.

The separator roller 63 is mounted on a shaft 65 that is, in turn, supported by an apparatus frame 76. A sheet feed motor 66 is located in the vicinity of the shaft 65 for driving the separator roller 63 and implemented by a stepping motor. The sheet feed motor 66 drives the shaft 65 via a timing belt 67. The timing belt 67 is passed over a drive pulley mounted on the output shaft of the motor 66 and a double, driven pulley mounted on the shaft 65.

An arm 68 is rotatable about the axis of the shaft 65 at one end thereof. The pickup roller 62 is rotatably mounted on the other end of the arm 68 via a shaft 69 and angularly movable up and down about the shaft 65 together with the arm 68. A timing belt 70 is passed over the double, driven pulley mounted on the shaft 65 and a pulley mounted on the shaft 69 of the pickup roller 62. The pickup roller 62 is therefore driven by the sheet feed motor 66 at the same time as the separator roller 63.

An upper limit sensor 71 is mounted on the apparatus frame 76 above the tray 54 for sensing the upper limit position of the top of the sheet stack 56. Specifically, when the top of the arm 68 contacts a feeler 71*a* included in the upper limit sensor 71, the sensor 71 determines that the top of the sheet stack 56 has reached its upper limit position. A lower limit sensor 94 is positioned below the tray 54.

The feed pressure adjusting mechanism is positioned above, but in the vicinity of, the separator roller 63. Specifically, a tension spring or feed pressure source 72 is anchored to the arm 68 at one end thereof. A slider 73 includes a rack 73*a* and is guided by guide means, not shown, in the up-and-down direction. A feed pressure motor 75 is implemented by a stepping motor for causing the slider 73 to move up and down. A pinion gear 74 is mounted on the output shaft of the feed pressure motor 75 and held in mesh with the rack 73*a*. A feed pressure position sensor 36 shown only in FIG. 11 senses the displacement of the slider 73.

The bias of the tension spring 72 causes a moment of rotation to act on the pickup roller 62 via the arm 68, so that a feed pressure is generated. When the feed pressure motor 75 is driven to move the slider 73 upward, as viewed in FIG. 1, the tension spring 72 is stretched to increase its bias and therefore the feed pressure. It is therefore possible to adjust the feed pressure stepwise by driving the motor 75.

The feed pressure position sensor 36 senses the displacement of the slider 73 with a configuration similar to, e.g., a position sensing board 52 included in a feed pressure adjusting mechanism 22 shown in FIG. 2 of previously mentioned Laid-Open Publication No. 9-235033.

Figure 2B:
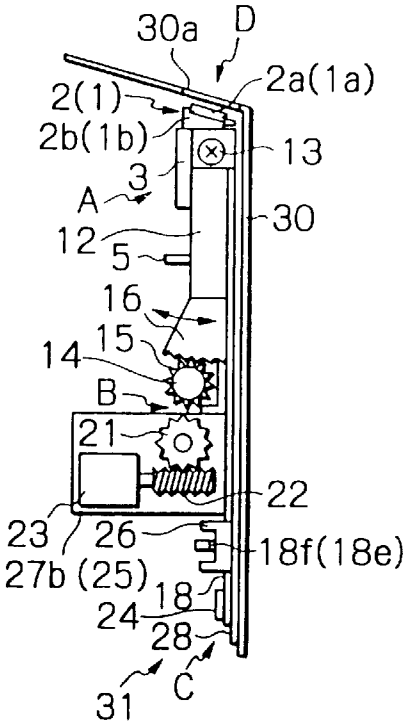
FIG. 2B is a front view of the sheet separating section.
Figure 2A:
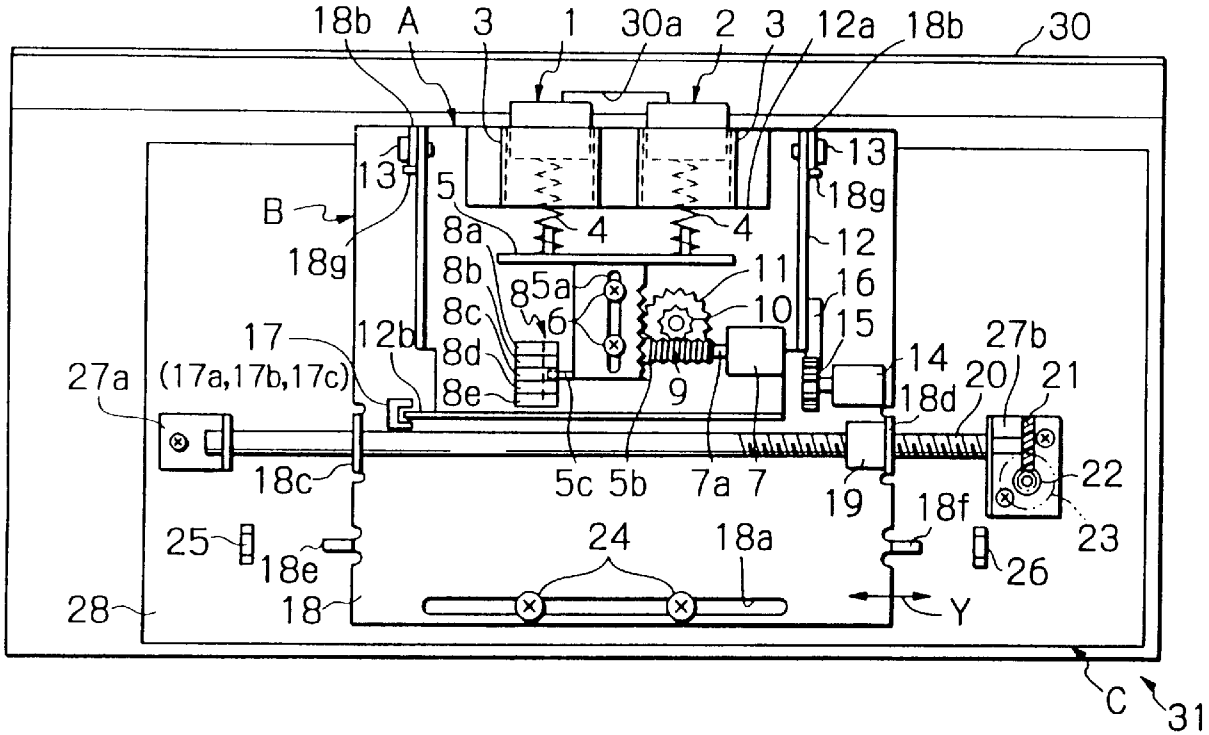
FIG. 2A is a side elevation of a sheet separating section included in the illustrative embodiment, as seen from the sheet discharge side.

As shown in FIGS. 2A and 2B, the separating portion 31 includes a plurality of separator pads 1 and 2 each having a particular coefficient of friction with respect to the sheets 56. The separating portion 31 is generally made up of a pad switching section C, a pad angle switching section B, and a pad pressure switching section A. The pad switching section C includes an automatic pad switching mechanism for automatically selecting one of the pads 1 and 2. The pad angle switching mechanism B includes an automatic separation angle switching mechanism for automatically switching the angle of the pad 1 or 2. The pad pressure switching mechanism A includes a separation pressure adjusting mechanism for adjusting the separation pressure of the pad 1 or 2. The pad pressure switching section A is constructed into a unit that is easy to assemble and disassemble. The pad switching section C and pad angle switching section. B are also easy to assemble and disassemble. The pad switching section C includes the pad angle switching section B and pad pressure switching section A. The pad angle switching section B includes the pad pressure switching section A. The pad 1 or 2 and the separator roller 63 constitute separating means for separating the top sheet 56 from the underlying sheets 56.

Figure 11:
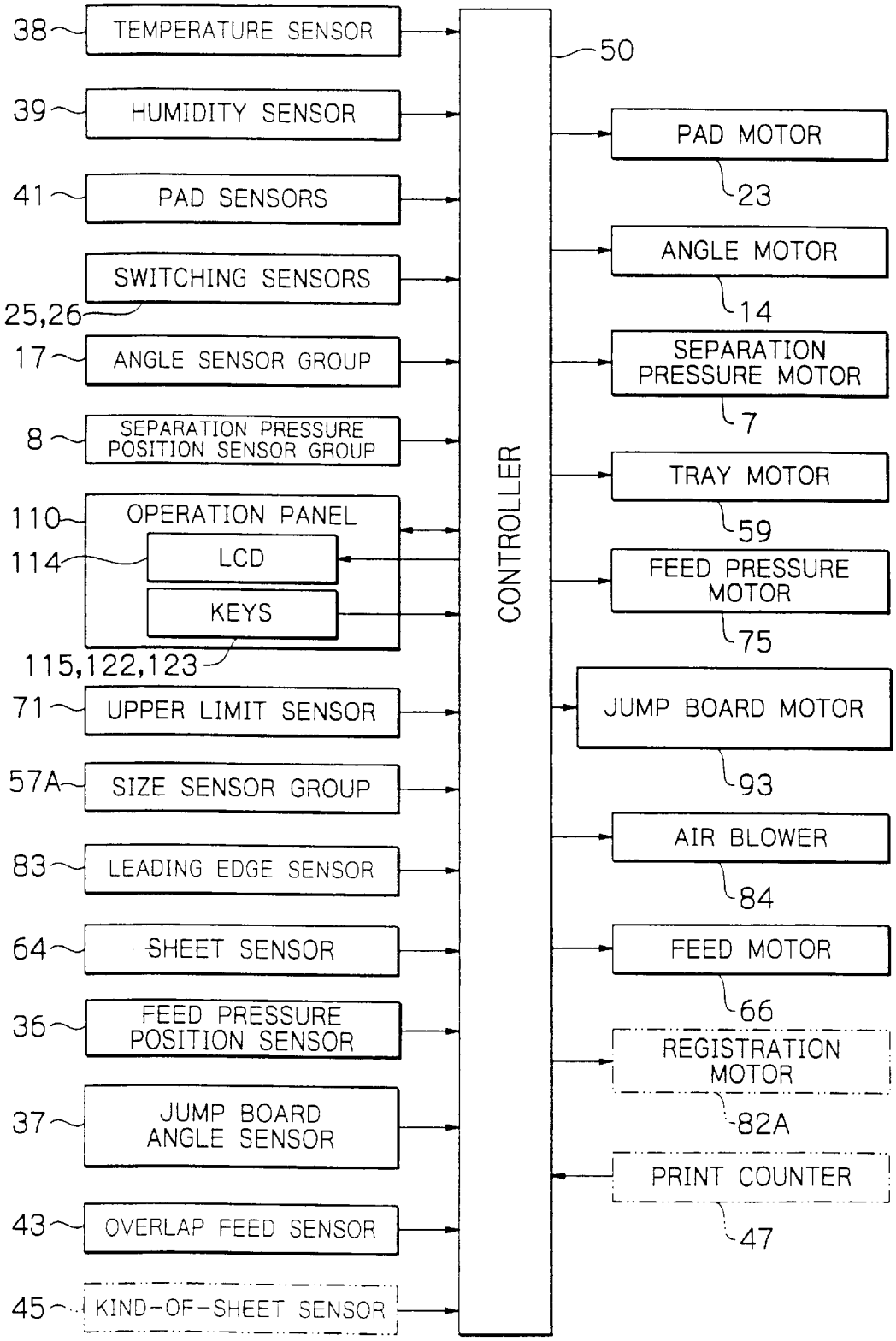
FIG. 11 is a block diagram schematically showing a control system included in the stencil printer.

A temperature sensor 38 and a humidity sensor 39 shown only in FIG. 11 are arranged in the vicinity of the separating portion 31 and pickup roller portion 32. The temperature sensor 38 and humidity sensor 39 are respectively responsive to temperature and humidity around the separating portion 31.

More specifically, the pad pressure switching section A includes a pair of pad holder guides or separator guide means 3 each for allowing one of the separator pads 1 and 2 to slide up and down therealong. The pad holder guides 3 are affixed to an angle varying member or moving means 12 which varies the angle of the pads 1 and 2. The separator pads 1 and 2 are held by holders 1*b* and 2*b*, respectively. Two compression springs or separation pressure sources 4 are respectively anchored to the holders 1*b* and 2*b* at one end thereof and to a press plate 5 at the other end thereof. The press plate 5 is supported by two stepped screws 6 in such a manner as to be movable up and down and includes a rack 5*b*. A pinion gear 11 is rotatably supported by the angle varying member 12 and held in mesh with the rack 5*b*. A worm wheel 10 is mounted on the same shaft as the pinion gear 11. A worm 9 is held in mesh with the worm wheel 10. A separation pressure motor 7 is affixed to the angle varying member 12 and includes an output shaft 7*a* on which the worm 9 is mounted. A separation pressure position sensor group 8 has five separation pressure position sensors 8*a*, 8*b*, 8*c*, 8*d* and 8*e* for sensing the displacement of the press plate 5.

The separator pads 1 and 2 serve as separating members for surely separating the sheets 56 one by one. Assume that the apparatus is operable with five different kinds of sheets, i.e., standard sheets, rough sheets, thin sheets, thick sheets and special sheets, as stated in relation to the prior art. Then, in the illustrative embodiment, the separator pads 1 and 2 are respectively assigned to standard sheets and special sheets by way of example.

As shown in FIGS. 2A, 2B, 3, 4A and 4B, the separator pads 1 and 2 respectively include pads 1*a* and 2*a* in addition to the holders 1*b* and 2*b* to which the pads 1*a* and 2*a* are adhered. The pads 1*a* and 2*a* each exert a friction force on the sheets 56. The pads 1*a* and 2*a* each have a particular coefficient friction. The pad 1*a* is assigned to standard sheets 56 and formed of ethylene-propylene rubber (EDPM), urethane or similar material having a relatively great coefficient of friction $\mu$ ranging from 1.1 to 1.2. The other pad 2*a* is assigned to special sheets or thick sheets and formed of urethane, EPDM or similar material having a coefficient of friction $\mu$ of 0.8 to 1.0.

Figure 4A:
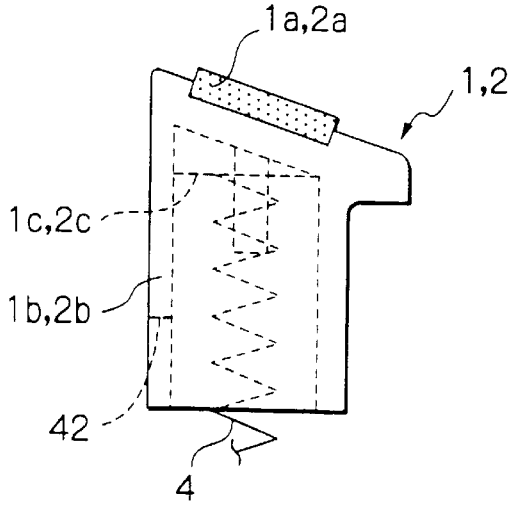
FIG. 4A is a front view of one of the separator pads.
Figure 4B:
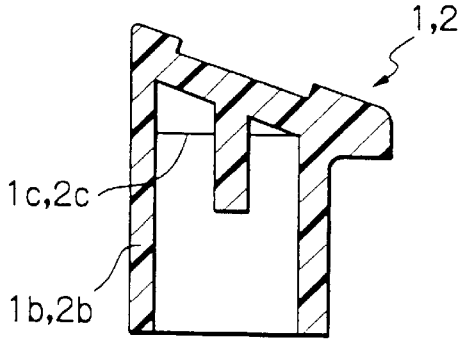
FIG. 4B is a section showing a pad holder from which a pad is removed.

As shown in FIGS. 4A and 4B in detail, the holders 1*b* and 2*b* each are a hollow molding of, e.g., polyacetal resin (POM), polyamide resin (PA) or similar synthetic resin. Ribs 1*c* and 2*c* are respectively formed in the inside of the holders 1*b* and 2*b* and serve as seats for the compression springs 4. The holders 1*b* and 2*b* may, of course, be implemented by die castings of aluminum or similar metal.

Figure 5:
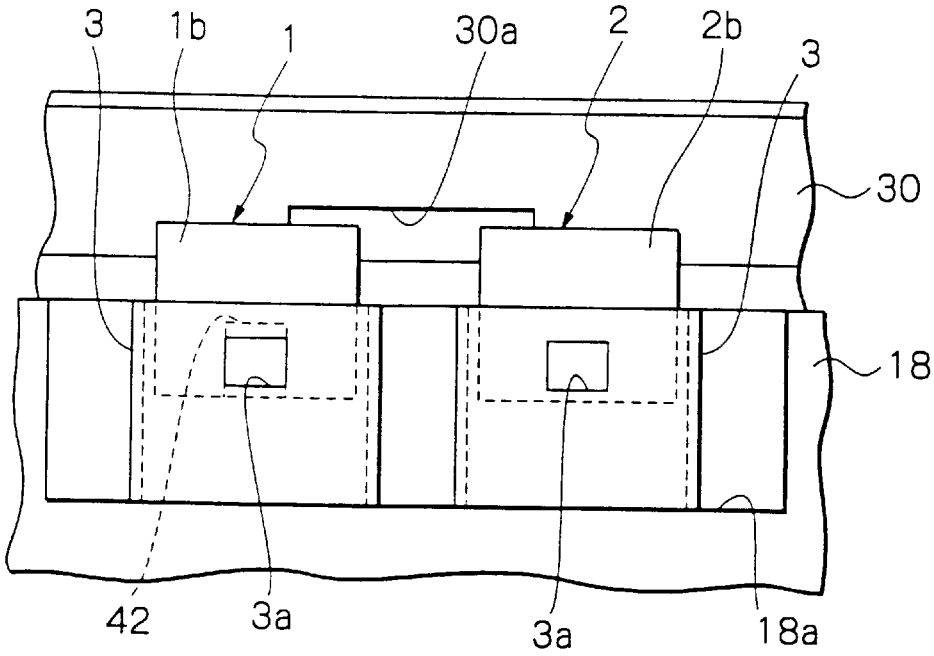
FIG. 5 is an enlarged view of the separator pads and members around them.
Figure 6:
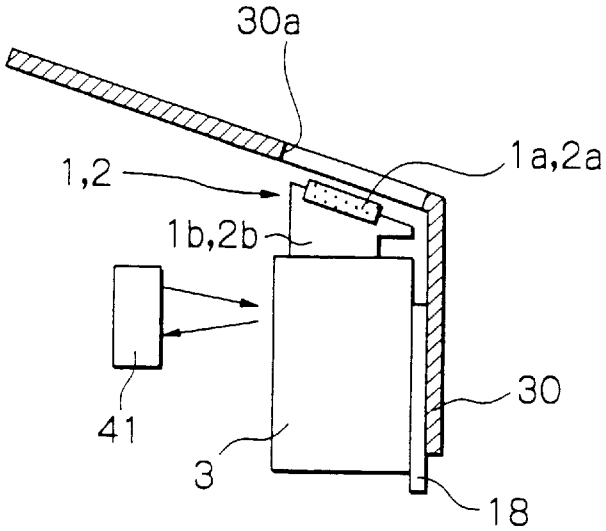
FIG. 6 is a front view showing one separator pad and a pad sensor.

The separating member switching mechanism mentioned earlier automatically replaces one of the separator pads 1 and 2 with the other. As shown in FIG. 6, pad sensors or separating member sensing means 41 are respectively positioned below the separator pads 1 and 2 for identifying the kinds of the pads 1 and 2. When the separator pads 1 and 2 are located at positions shown in FIG. 5 by way of example, the pad sensors 41 are respectively positioned at the left of the pad holder guides 3 slidably accommodating the holders 1*b* and 2*b*. The pad sensors 41 are implemented by reflection type optical sensors. As shown in FIG. 5, the pad holder guides 3 each are formed with a window 3*a* aligning with associated one of the pad sensors 41.

As shown in FIGS. 4 and 5, a notch 42 is formed in the left side wall of the holder 1*b* holding the standard separator pad 1 while such a notch is not formed in the other holder 2*b* holding the special separator pad 2. Therefore, the pad sensor 41 turns on when it does not sense the notch 42 or turns off when it senses the notch 42. A controller, which will be described later, is capable of determining the kinds of the reflector pads 1 and 2 on the basis of the outputs of the pad sensors 41. When three or more separator pads are used, they may be distinguished by the number of notches 42 while the number of pad sensors 41 may be equal to the maximum number of notches 42.

The above notch 42 for distinguishing the pads 1 and 2 may be replaced with an aperture or with black and white or similar colors respectively provided on the tops of the holders 1*b* and 2*b*. In such a color scheme, the pad sensors 41 each receive a particular amount of reflection from the associated holder 1*b* or 2*b* due to a difference in reflectance between the colors, so that the controller can distinguish the pads 1 and 2 on the basis of the output levels of the sensors 41. If desired, the holders 1*b* and 2*b* each may have its entire surfaces or only its top surface or even only its portion to be illuminated by the pad sensor 41 colored.

The angle varying member 12 has a box-like configuration. As shown in FIG. 2A, this member 12 has a recess 12*a* for mounting the bottoms of the pad holder guides 3. A screen piece 12*b* protrudes from the left side wall of the lower portion of the member 12.

The press plate 5 is generally inverted L-shaped as seen in a side elevation and formed with a slot 5*a* elongate in the up-and-down direction. The previously mentioned two stepped screws 6 are driven into the angle varying member 12 via the slot 5*a*. In this condition, the stepped screws 6 and slot 5*a* constitute guide means for slidably guiding the press plate 5 in the up-and-down direction.

The separation pressure motor 7 is implemented by a stepping motor and plays the role of separation pressure variation drive means. The separation pressure position sensors 8*a* through 8*e* each are a transmission type optical sensor including a light emitting portion and a light receiving portion. The separation pressure position sensor group 8 senses the displacement of the press plate 5 with the sensors 8*a* through 8*e* selectively aligning with the screen piece 5*c* of the press plate 5.

The separation pressure adjusting mechanism includes the separator pads 1 and 2, compression springs 4, press plate 5, rack 5*b*, pinion gear 11, worm wheel 10, worm 9, separation pressure motor 7 and separation pressure position sensor group 8, as stated previously. Most of the parts constituting the separation pressure adjusting mechanism are mounted on the angle varying member or base member 12.

Figure 3:
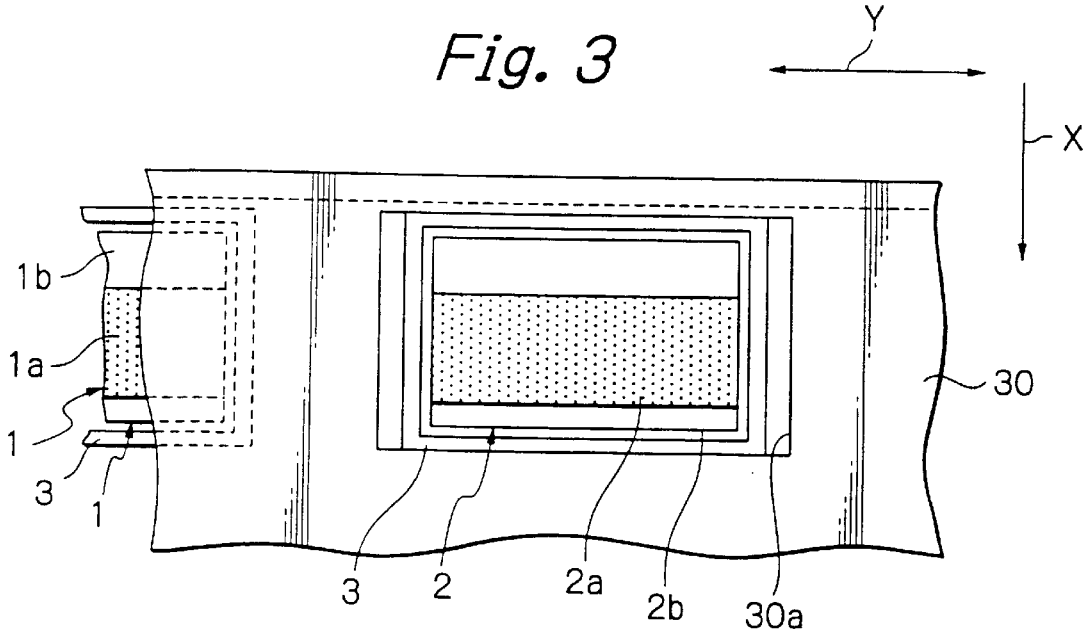
FIG. 3 is an enlarged view of separator pads included in the sheet separating section together with members around them, as seen in a direction indicated by an arrow D in FIG. 2B.

The separation pressure adjusting mechanism may be regarded as a separation pressure canceling mechanism for automatically canceling the separation pressure acting on the sheets 56 and including the separation pressure motor or separation pressure cancellation drive means 7. Specifically, as shown in FIG. 3, the separator pad 2, for example, usually protrudes from a rectangular hole 30*a* formed in a front wall 30 and remains in contact with the separator roller 53 via the sheet stack 56 for generating a separation pressure. Therefore, to automatically replace the separator pad 2 with the separator pad 1, it is necessary to cancel the pressure generating state of the pad 2. More specifically, as shown in FIGS. 2A and 2B, the separation pressure motor 7 lowers the press plate 5 until the top of the pad 2*a* fully retracts downward from the hole 30*a* of the front wall 30. This is successful to prevent the pad 2*a* or the holder 2*b* from being caught by the edges of the hole 30*a*, to prevent the pad 2*a* and separator roller 63 contacting each other from scratching each other, and to prevent the pad 2*a* and holder 2*b* from sliding on the rear surface of the front wall 30 and being damaged thereby.

The operation of the separation pressure adjusting mechanism will be described more specifically. Before the operation begins, the separating member switching mechanism automatically selects one of the separator pads 1 and 2. Assume that the mechanism has selected the separator pad 2. Then, the pad 2 protrudes from the hole 30*a* of the front wall 30 with its top contacting the separator roller 63. The compression spring 4 presses the above pad 2 against the separator roller 63 to thereby generate a separation pressure. When the separation pressure motor 7 is driven, the output torque of the motor 7 is transferred to the rack 5*b* via the worm 9, worm wheel 10 and pinion gear 11. As a result, the press plate 5 is moved upward, as viewed in FIGS. 2A and 2B, while being guided by the stepped screws 5 and compressing the compression spring 4. Consequently, the above pressure (compression load) and therefore the separation pressure increases. Conversely, when the motor 7 causes the press plate 5 to move downward, as viewed in FIGS. 2A and 2B, it causes the compression spring 4 to stretch. This reduces the above pressure or compression load and therefore the separation pressure. In this manner, with the motor 7, it is possible to adjust the separation pressure stepwise. For example, with the motor 7 and five separation position sensors 7*a*–8*e*, it is possible to adjust the separation pressure in five consecutive steps.

To automatically control the above separation pressure in a greater number of steps, the illustrative embodiment may include a greater number of separation position sensors and control the separation pressure motor 7 in accordance with the outputs of such sensors. The separation pressure position sensor group 8 playing the role of means for sensing the position of the press plate 5 may be replaced with, e.g., a photoencoder mounted on the output shaft of the motor 7 and a single home position sensor responsive to the home position of the press plate. Further, the sensor group 8 may be replaced with only the photoencoder if the motor 7 is capable of being controlled by open loop control.

The pad angle switching section B is made up of the pad pressure switching section A, the angle varying member 12, a sector gear 16, a drive gear 15 meshing with the gear 16, an angle motor 14, and an angle sensor group 17. The angle varying member 12 is angularly movable about two stepped fulcrum screws 13. The gear 16 is mounted on the lower portion of the right wall of the angle varying member 12, as viewed in FIG. 2A. The angle motor 14 is mounted on a movable member 18 and has the drive gear 15 mounted on its output shaft. The angle sensor group or angle sensing means 12 senses the angle of the separator pad 1 or 2 via the angular displacement of the angle varying member 12.

As shown in FIG. 2A, the upper ends of the movable member 18 spaced from each other in the direction Y are cut and bent to form support portions 18*b* supporting the opposite ends of the angle varying member 12. In FIG. 2A, portions 18*g* are the cut portions of the movable member 18. An elongate slot 18*a* is formed in the lower portion of the movable member 18 in the direction Y so as to guide the movable member 18 in the direction Y. Screen pieces 18*e* and 18f respectively protrude from the left edge and right edge of the movable member 18 in the direction Y. The right and left end portion of the movable member 18 in the direction Y are bent to form inserting portions 18*c* and 18*d*, respectively. A ball screw 20 has a shank portion and a screw portion respectively inserted in the inserting portions 18*c* and 18*d*, so that the ball screw 20 is axially movable and rotatable about its axis.

Holes, not shown, are formed in the top right and top left portions of the angle varying member 12. The two stepped fulcrum screws 13 are respectively held in threaded engagement with the support portions 18*b* and 18*b* via the above holes of the angle varying member 12. In this condition, the angle varying member 12 is selectively rotatable clockwise or counterclockwise, as viewed in FIG. 2B, over a preselected angular range.

The angle motor 14 is implemented by a stepping motor and plays the role of drive means for the separation angle switching mechanism. The motor 14 is mounted on the movable member 18 which is, in a sense, the base member of the pad angle switching section B.

The angle sensor group 17 is made up of three angle sensors 17*a*, 17*b* and 17*c* responsive to the angular positions of the angle varying member 12. The angle sensors 17*a*–17*c* each are an optical sensor having a light emitting portion and a light receiving portion. The screen piece 12*b* selectively screens the optical path of the angle sensors 17*a*–17*c*, indicating the angular position of the angle varying means 12, i.e., the angle of the separator pad 1 or 2.

The separation angle switching mechanism is made up of the pad pressure switching portion A, angle varying means 12, stepped fulcrum screws 13, gear 16, drive gear 15, angle motor 14, and angle sensor group 17, as stated previously. The operation of the separation angle switching mechanism will be described more specifically hereinafter.

When the angle motor 14 is driven, its output torque is transferred to the gear 18 via the drive gear 15. Asia result, the angle varying member 12 is angularly moved about the fulcrum screws 13 clockwise or counterclockwise over a preselected range. For example, when the member 12 is moved clockwise, as viewed in FIG. 2B, for moving the movable member 18 in the direction Y. The worm wheel 21 is affixed to one end of the ball screw 20 and held in mesh with the worm wheel 21. The pad motor 23 is affixed to a base 28 via a bearing member 27*b* and has the worm 22 on its output shaft. The sensors or switching sensing means 25 and 26 are responsive to the displacement of the movable member 18, i.e., switching between the separator pads 1 and 2.

The base 28 is affixed to a front panel 30 by screws. The bearing member 27*b* and another bearing member 27*a* are fastened to the base 28 by screws not shown. The bearing member 27*a* supports the left end of the ball screw 20 via a stop ring, not shown, such that the ball screw 20 is rotatable, but not movable in the direction Y. Likewise, the bearing member 27*b* supports the right end of the ball screw 20 via a stop ring, not shown, such that the ball screw 20 is rotatable, but not movable in the direction Y. Two stepped screws 24 are driven into the base 28 via a slot 18*a* formed in the movable member 18, allowing the member 18 to move in the direction Y in FIG. 2A.

The pad motor 23 is implemented by a stepping motor and serves as drive means for the separation member switching mechanism. The motor 23 is affixed by screws to the base 28 which is, in a sense, the base member of the pad switching section C.

The switching sensors 25 and 26 each are an optical sensor made up of a light emitting portion and a light receiving portion. The screen pieces 18*e* and 18*f* each selectively meet the associated sensor it increases the angle of the separator pad 2 (pad 2*a*) when the member 12 is moved counterclockwise, it reduces the angle of the pad 2. At this instant, the angle of the separator pad 2 is determined on the basis of the outputs of the angle sensors 17*a*–17*c* which the screen piece 12*b* of the angle varying member 12 selectively meets. With the motor 14 and three angle sensors 17*a*–17*c*, the illustrative embodiment is capable of automatically switching the angle of the separator pad 1 or 2 in three steps.

To automatically control the angle of the separator pad 1 or 2 in a greater number of steps, the illustrative embodiment may include a greater number of angle sensors and control the angle motor 7 in accordance with the outputs of such sensors. The angle sensor group 17 playing the role of means for sensing the angle of the angle varying member 12 may be replaced with, e.g., a photoencoder mounted on the output shaft of the motor 14 and a single home position sensor responsive to the home position of the angle varying member 12. Further, the sensor group 17 may be replaced with only the photoencoder if the motor 14 is capable of being controlled by open loop control.

The pad switching section C is made up of the pad pressure switching section A, the pad angle switching section B, a ball nut 19, the ball screw 20, a worm wheel 21, a worm 22, a pad motor 23, and two sensors 25 and 26. The ball nut 19 is affixed to the right bent end of the movable member 118 and held in threaded engagement with the ball screw 20, constituting separating member moving means 25 or 26, indicating the switched position of the separator pad 1 or 2.

The pad switching mechanism is made up of the pad pressure switching section A, pad angle switching section B, ball nut 19, ball screw 20, worm wheel 21, worm 22, pad motor 23 and sensors 25 and 26, as stated above. The operation of the pad switching mechanism will be described more specifically. When the pad motor 23 is driven, its output torque is transferred to the ball screw 20 (e.g. right-hand thread) via the worm 22 and worm wheel 21. The ball screw 20 causes, in cooperation with the ball nut 19, the pad pressure switching section and pad angle switching section B to move by being guided by the stepped screws 24 in the direction opposite to the direction of movement of the above thread. Consequently, one of the pads 1 and 2 is automatically selected and sensed by the associated switching sensor 25 or 26.

To automatically select a greater number of separator pads at a time, the illustrative embodiment may include a greater number of switching sensors and control the pad motor 23 in accordance with the outputs of such sensors. The switching sensors 25 and 26 playing the role of means for sensing the positions of the movable member 18 may be replaced with, e.g., a photoencoder mounted on the output shaft of the motor 23 and a single home position sensor responsive to the home position of the movable member 18. Further, the sensors 25 and 26 may be replaced with only the photoencoder if the motor 23 is capable of being controlled by open loop control.

While the illustrative embodiment includes all of the separating member switching mechanism, separation angle switching mechanism and separation pressure adjusting mechanism, it may include only one of the separating member switching mechanism and separation angle switching mechanism with or without the separation pressure adjusting mechanism.

Referring again to FIG. 1, the registration rollers 81 and 82 are located upstream of the press roller 80 in the direction X for conveying the sheet 56 toward the print position between the print drum 51 and the press drum 80. A drive mechanism including a registration motor or stepping motor 82A causes each of the registration rollers 81 and 82 to rotate in a particular direction, as indicated by an arrow in FIG. 1. The registration rollers 81 and 82 therefore drive the leading edge of the sheet 56 at a preselected timing matching with the rotation of the print drum 51. Specifically, the lower registration roller 82 is a drive roller having a driven pulley, not shown, mounted on its shaft. A timing belt, not shown, is passed over the driven pulley and a drive pulley, not shown, mounted on the output shaft of the registration motor 82A. The motor 82A causes the registration roller 82 to rotate via the timing belt. A leading edge sensor 83 is positioned upstream of the two rollers 81 and 82 in the direction X for sensing the leading edge of the sheet 56. The leading edge sensor 83 is implemented by a reflection type optical sensor.

An overlap feed sensor or overlap feed sensing means 43 (shown only in FIG. 11) is located on a sheet path between the leading edge sensor 83 and the separator portion 31 for sensing the simultaneous feed of two or more sheets 56. This sensor 43 may be implemented by, e.g., a transmission type optical sensor capable of sensing the thickness of sheets 56 in terms of the intensity of reflection or a reflection type optical sensor responsive to the level of the quantity of reflection.

A print counter 47 (shown only in FIG. 11) is additionally included in the stencil printer 200 for counting the sheets 56 fed in terms of the sheets 56 subjected to printing. Specifically, a suction unit includes a conveyor belt 85, a suction fan 86 and a sheet discharge sensor not shown. The print counter or counting means 47 counts prints on the basis of the number of times of ON/OFF operations of the sheet discharge sensor. Alternatively, the controller which will be described may count the number of times of ON/OFF operations of the leading edge sensor 83 in order to directIly determine the number of sheets fed.

The sheet discharge section 260 includes an air blower 84, a print conveying device, a right and a left jump board 90, and a tray 87. In the print conveying device, the conveyor belt 85 is passed over a front roller 85A and a rear roller 85B while the suction fan 86 is caused to retain a sheet 56*a* on the belt 85 by suction. This kind of configuration is conventional and will not be described specifically.

The sheet or print 56*a* carrying an image thereon is peeled off from the print drum 51 by the air blower 84 and then driven out to the tray 87 by the belt 85 while being sucked by the suction fan 86. The tray 87 has an end fence 88 and a pair of side fences arranged thereon. The end fence 88 stops the leading edge of the print 56*a* and thereby positions the leading edge and training edge of the print 56*a*. The side fences 89 position the opposite side edges of the print 56 by guiding them.

The right and left jump boards 90 cause the print 56*a* being driven out to the tray 87 to bend in the form of a letter U, thereby providing the print 56*a* with an adequate degree of rigidity. A rack-like slider 91 is anchored at one end to part of each jump board 90 and guided by guide means, not shown, in substantially the up-and-direction.

A jump board motor 93 is located in the vicinity of the slider 91 for moving the slider 91 in the up-and-down direction. A pinion gear 92 is mounted on the output shaft of the jump board motor 93 and held in mesh with a rack 91*a* included in the slider 91. The jump board motor 93 is implemented by a stepping motor. A jump board angle sensor 37 (shown only in FIG. 11) adjoins the lower end of the slider 91 for sensing the displacement of the slider 91. The jump board angle sensor 37 senses the displacement of the slider 91 with a configuration similar to the feed pressure position sensor 36 and separation pressure position sensor group 8.

As stated above, by driving the jump board motor 93, it is possible to adjust the angle of the jump boards 90 stepwise and therefore to control the degree of curvature or rigidity of the sheet 56*a*.

The document scanning section 210 is arranged on the top of the apparatus frame 6. An operation panel 11 shown in FIG. 8 is also mounted on the top of the apparatus frame 76 above the document scanning section 210.

As shown in FIG. 8, the operation panel 110 includes a start key 111 for starting a sequence beginning with printing, including document reading, master discharging, master making and master wrapping, and ending with sheet discharging. Numeral keys 113 are used to input a desired number of prints and other numerical values. A print key 112 causes the number of prints input on the numeral keys 113 to be output when pressed. A proof print key 113A is used to start a proof printing operation. An LCD (Liquid Crystal Display) or display means 114 displays operation statuses, messages, functions selected and so forth as well as guidance for the selection of desired functions, as needed. Four select keys 115 are respectively positioned below four items "Kind of Document (Doc)", "Magnification (Mag) Change", "King of Sheets" and "Position Adjustment (Adj)" appearing in four elongate frames at the bottom of the LCD 114. Four scroll keys 123*c*, 123*a*, 123*b* and 123*d* (123 collectively) are used to select a desired function in any one of four different directions. In FIG. 8, a print mode picture for a usual basic operation is shown as appearing on the LCD 114. When an initial set key 122 is pressed, the LCD 114 replaces the print mode picture with an initial set mode picture or menu picture for allowing the operator to change the initial values of various functions or to set operating conditions in accordance with desired conditions of use.

The proof print key 113A causes a single proof print to be output when pressed once or causes a plurality of proof prints to be output when continuously pressed.

The controller, which will be described, controls the LCD 114 via an LCD driver included in an LCD device, not shown. As for the select keys 115, the leftmost key, as viewed in FIG. 8, assigned to "Kind of Doc" allows the operator to set the font of a document. The key assigned to "Mag Change" is used to set a magnification for enlargement or reduction in accordance with a document size. The key, labeled 119, assigned to "Kind of Sheets" is used to select the kind of sheets 56. Further, the rightmost key assigned to "Position Adj" allows the operator to adjust the position of an image tube printed on each sheet 56. Why only the key assigned to "Kind of Sheets" is labeled 119 is that the contents of operation available with the other keys are not relevant to the understanding of the illustrative embodiment.

The print mode picture shown in FIG. 8 appears on the LCD 114 first when a power switch, not shown, provided on the printer 200 is turned on.

An operation status or a message appears in the top rectangular column of the print mode picture; a message "Ready to make a master and print." is shown as appearing in the above column in FIG. 8, showing the operator that the printer 200 is ready to execute the previously stated sequence. When the key 119 is pressed once, the lower portion of the print mode picture is replaced with a picture shown in FIG. 9. The picture of FIG. 9 includes "←(left arrow)", "→(right arrow)", "Condition Change" and "Set" as named from the left to the right. A left key 117, a right key 118, a condition change key 120 and a set key 116 are respectively assigned to "←", "→", "Condition Change" and "Set" and constitute the select key group 115.

The condition change key 120 allows the operator to select functions for changing sheet feed conditions relating to misfeed, overlap feed or similar defective sheet feed. This key 120 will not be described specifically because it does not lie in the scope of the present invention.

The key or kind-of-sheet setting means 119 allows the operator to set the kind of sheets 56 to use. The "77 " key 117 also forms part of the kind-of-sheet setting means and causes, e.g., a function (job information) to be sequentially shifted to the left on the LCD 114. The "→" key 118 also forms part of the kind-of-sheet setting means and causes, e.g., the function (job information) to be sequentially shifted to the right on the LCD 114. The scroll keys 123 also form part of the kind-of-sheet setting means.

Figure 10:
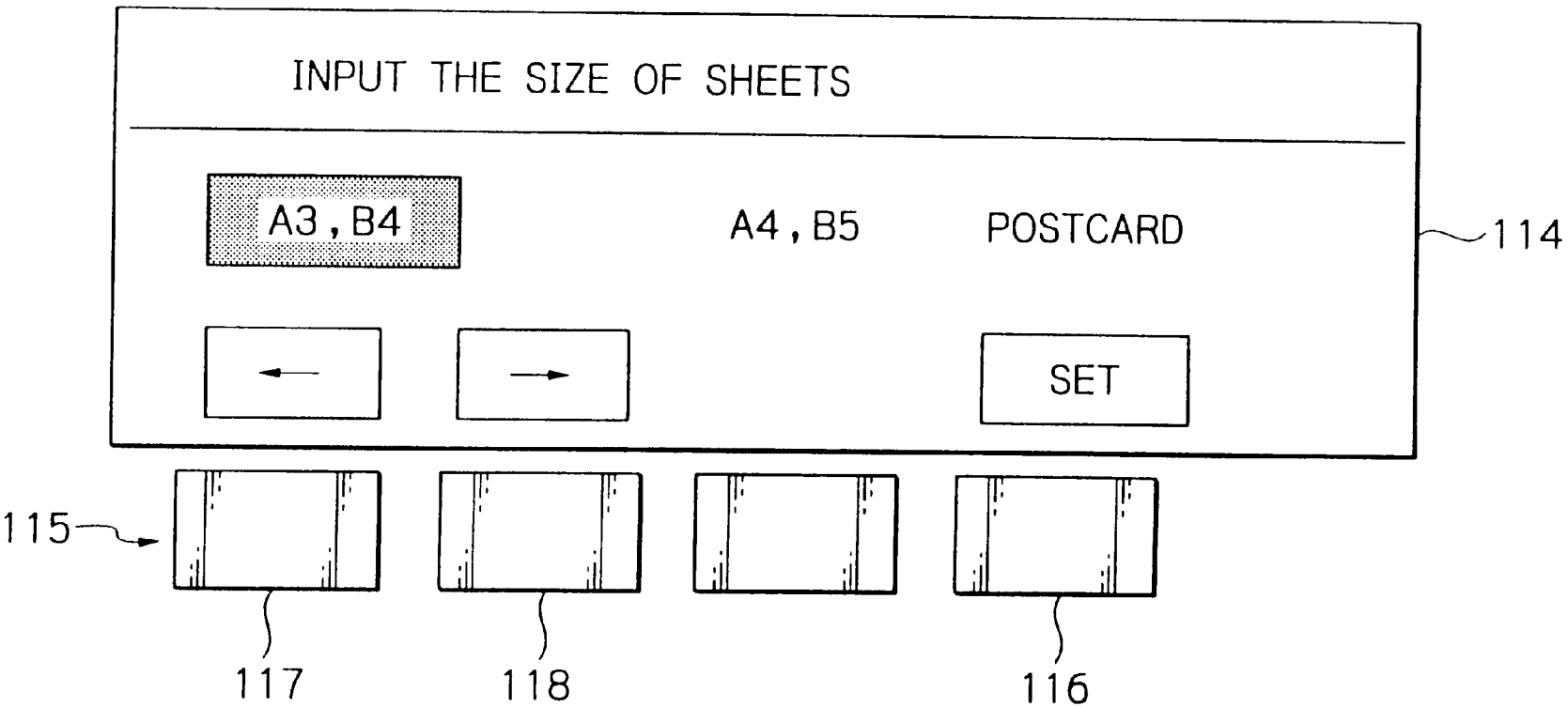
FIG. 10 is a fragmentary plan view showing another specific picture appearing on the LCD.

When the initial set key 122 is pressed once, a picture shown in FIG. 10 appears on the LCD 114.

As stated above, the scroll keys 123 and select key group 115 (set key 116, "←" key 117, "→" key 118 and kind-of-sheet key 119) constitute the kind-of-sheet setting means for setting the kind of sheets 56. The initial set key 122, scroll keys 123 and select key group 115 (set key 116, "←" key 117 and "→" key 118) constitute sheet size setting means for setting the size of sheets 56.

The above kind-of-sheet setting means and sheet size setting means each are implemented by the combination of a plurality of keys appearing on a so-called menu picture. Alternatively, such setting means may be implemented by an independent key capable of displaying the size of sheets 56 selected via an LED (Light Emitting Diode) every time it is pressed.

Referring to FIG. 11, the controller or control means, labeled 50, is implemented as a microcomputer including a CPU (Central Processing Unit), I/O ports, a ROM (Read Only Memory), a RAM (Random Access Memory), a PROM (Programmable ROM), and a timer although not shown specifically. These constituents of the microcomputer are interconnected by a signal bus. The ROM stores beforehand adequate sheet feed condition data to be described later and determined by, e.g., experiments, a program for operating the printer 200, etc. The RAM serves as a work area for storing, e.g., interim data.

The controller 50 adequately receives signals output from the temperature sensor 38, humidity sensor 39, pad sensors 41, switching sensors 25 and 26, angle sensor group 17, separation pressure position sensor group 8, keys (select key group 115 ("←" key 117, "→" key 118, kind-of-sheet key 119 and set key 116), initial set key 122 and scroll keys 123), upper limit sensor 71, sheet size sensor group 57A, leading edge sensor 83, sheet sensor 64, sheet feed position sensor 36, jump board angle sensor 37, overlap feed sensor 43, kind-of-sheet sensor 45, and print counter 47. In response, the controller 50 adequately controls the LCD 114, pad motor 23, angle motor 14, separation pressure motor 7, tray motor 59, feed pressure motor 75, jump board angle motor 93, air blower 84, sheet feed motor 66, and registration motor 82A. It is to be noted that blocks indicated by dash-and-dots lines in FIG. 11 are not used in this embodiment.

The controller 50 has the following various functions.

First, in response to signals output from the kind-of-sheet setting means (scroll keys 123 and select key group 115 (set key 116, "←" key 117, "→" key 118 and set key 116)), the controller causes the pad motor 23 to automatically select the separator pad 1 or 2 matching with the kind of the sheets 56.

Second, in response to signals output from the kind-of-sheet setting means (scroll keys 123 and select key group 115 (set key 116, "←" key 117, "→" key 118 and kind-of-sheet key 19)),the controller 50 causes the angle motor 14 to automatically switch the preset angle of the separator pad 1 or 2 to an angle matching with the kind of the sheets 56.

Third, in response to signals output from the temperature sensor 38 and humidity sensor 39, the controller 50 causes the pad motor 23 to automatically select the separator pad 1 or 2 in accordance with temperature, humidity and other environmental conditions.

Fourth, in response to signals output from the temperature sensor 38 and humidity sensor 39, the controller 50 causes the angle motor 14 to automatically switch the angle of the separator pad 1 or 2 in accordance with temperature, humidity and other environmental conditions.

Fifth, when the overlap feed of the sheets 56 occurs more than a preselected number of times, as determined by the overlap feed sensor 43, the controller 50 causes the pad motor to automatically select a new separator pad 1 or 2.

Sixth, when the overlap feed of the sheets 56 occurs more than a preselected number of times, as determined by the overlap feed sensor 43, the controller 50 causes the angle motor 14 to automatically select the angle of the separator pad 1 or 2 matching with the frequency of overlap feed.

Seventh, when the separator pad 1 or 2 is to be automatically replaced, the controller 50 causes the separation pressure motor 7 to cancel the separation pressure and then causes the motor 7 to select a new separator pad 2 or 1.

Eighth, when the new separator pad 1 or 2 automatically selected is the last pad available, the controller 50 causes the LCD 114 to display a message indicative of the absence of spare pads via the LCD driver.

Ninth, when the new separator pad 1 or 2 is automatically selected, the controller 50 causes the separation pressure motor 7 to automatically select a separation pressure matching with the pad 1 or 2 and set up the separation pressure.

Tenth, when the new separator pad 1 or 2 is automatically selected, the controller 50 automatically selects and sets a feed pressure, an amount of feed and other sheet feed conditions matching with the pad 1 or 2. In this sense, the controller 50 plays the role of sheet feed condition control means. More specifically, in the illustrative embodiment, the controller 50 automatically selects a feed pressure, a separation pressure, a jump board angle and an amount of loop and controls the motors 75, 7, 93 and 66 in accordance with such sheet feed conditions. The amount of loop is representative of the amount of sheet feed, as will be described specifically later.

Eleventh, the controller or sheet feed condition control means 50 automatically selects and sets a sheet feed pressure, an amount of sheet feed and other sheet feed conditions in accordance with the angel of the separator pad 1 or 2 automatically selected. More specifically, in the illustrative embodiment, the controller 50 automatically selects a feed pressure, a separation pressure, a jump board angle and an amount of loop and controls the motors 75, 7, 93 and 66 in accordance with such sheet feed conditions.

As for the above tenth function, the controller 50 may automatically select at least one of the various sheet feed conditions matching with the separator pad 1 or 2 and control at least one of the motors 75, 7, 93 and 66 in accordance with the condition or conditions selected.

Also, as for the eleventh function, the controller 50 may automatically select at least one of the various sheet feed conditions matching with the angle of the separator pad 1 or 2 and control at least one of the motors 75, 7, 93 and 66 in accordance with the condition or conditions selected.

The operation of the printer 200 will be described hereinafter. When the operator turns on the power switch of the printer 200, the initial picture shown in FIG. 8 appears on the LCD 114 of the operation panel 110. The initial picture shows the content of a job to be performed by the operator in its upper portion ("Ready to make a master and print."), as stated earlier.

Figure 9:
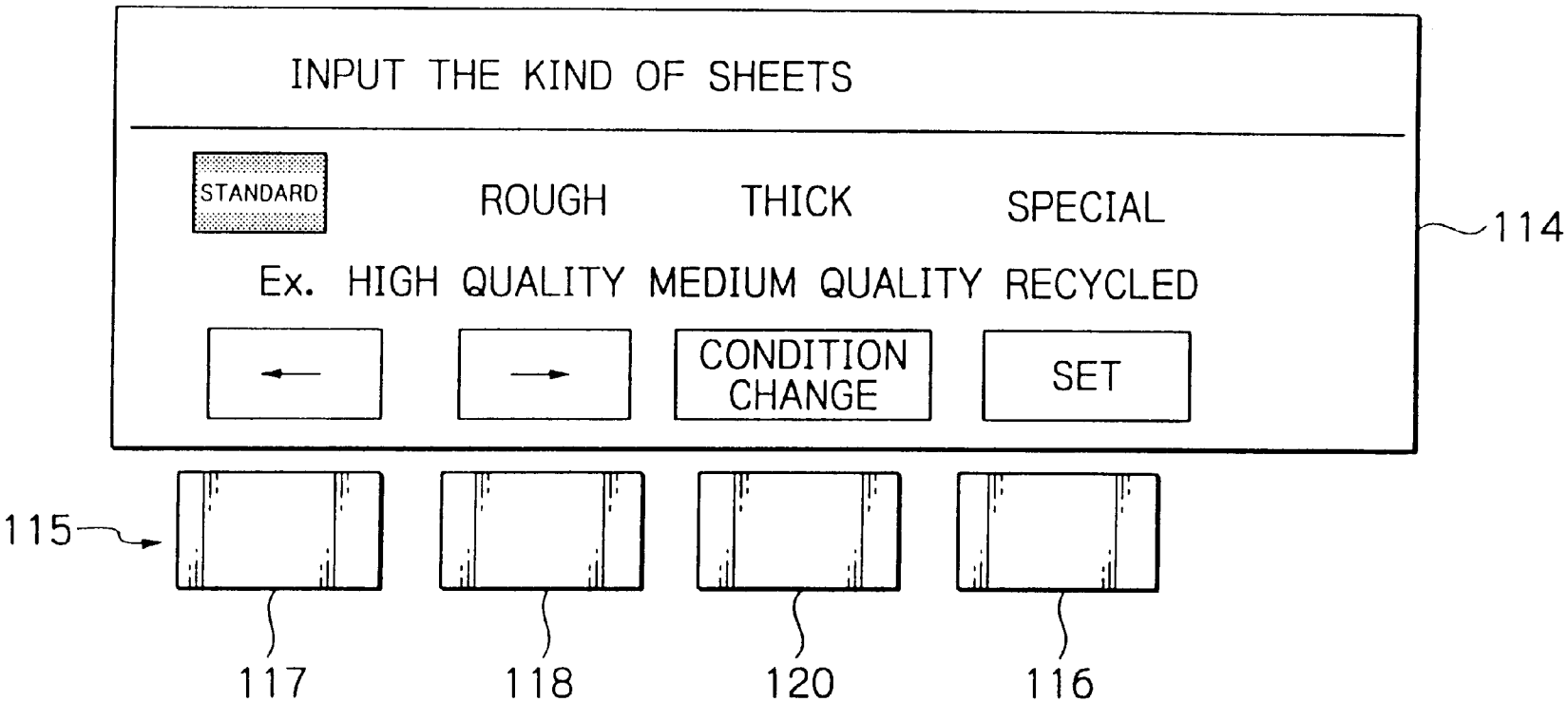
FIG. 9 is a fragmentary plan view showing a specific picture appearing on an LCD included in the operation panel together with keys adjoining the LCD.

When the operator watching the LCD 114 presses the kind-of-sheet key 119, the picture of FIG. 9 appears on the LCD 114 in place of the initial picture. The picture of FIG. 9 includes five different kinds of sheets, i.e., "Standard", "Rough", "Thin", "Thick" and "Special". This allows the operator to select one of the five kinds of sheets by using the kind-of-sheet setting means, i.e., the scroll keys 123 and select key group 115. With this configuration, it is possible to automatically select optimal one of the separator pads 1 (standard) and 2 (special) in accordance with the kind of sheets 56, to automatically set up an optimal angle of the pad 1 or 2 matching with the kind of sheets 56, and to minutely set up optimal sheet feed conditions in accordance with the kind and angle of the pad selected. If this kind of setting is not necessary, there may be effected setting conforming to the previously stated functions available with the controller 50, as proved by trial manufacture and experiments.

In FIG. 9, "Standard", for example, representative of standard sheets is not specific alone. In light of this, when the operator sets the kind of sheets 56 on the kind-of-sheet setting means, more specific contents of "Standard" are displayed at the same time and can be readily selected by the operator.

Usually, when the operator presses the kind-of-sheet key 119, "Standard" is highlighted in black. In this condition, the operator may press the scroll key 123*c* or 123*a* to shift the highlighted portion and then enter it on the set key 116. In FIG. 9, "Standard" is selected, and "High Quality", "Medium Quality" and "Recycled" representative of more specific contents of "Standard" are displayed below "Standard" and headed by "Ex. (Example)". When "Thin" designating thin sheets is selected, "Thin" and "Thin Noshigami" will be displayed below "Thin" and also headed by "Ex.". This is also true with "Rough" and "Thick", as shown in FIG. 12 specifically. When the operator selects the kind of sheets 56 and sets it on the set key 116, the controller 50 controls the various sections to automatically perform the following operation.

The controller 50 selects one of the separator pads 1 (standard) and 2 (special) having a coefficient of friction optimally matching with the kind of sheets 56 selected by the operator and temperature, humidity and other environmental conditions, as shown in FIG. 12 specifically. More specifically, the controller 50 controls the pad motor 23 while referencing the outputs of the kind-of-pad sensors 41, switching sensors 25 and 26, temperature sensor 38 and humidity sensor 39. At the same time, the controller 50 controls the angle motor 14 in order to set up an optimal angle of the separator pad 1 or 2 selected while referencing the outputs of the angle sensor group 17, temperature sensor 38 and humidity sensor 39.

Specific sheet feed conditions shown in FIG. 12 are optimal values determined beforehand on the basis of, e.g., experimental data and stored in the ROM mentioned earlier.

The controller 50 automatically selects an optimal feed pressure, an optimal separation pressure, an optimal jump board angle and an optimal amount of loop or sheet feed shown in FIG. 12 and matching with the kind of sheets 56 selected by the operator and the kind and angle of the pad. The controller 50 then drives the feed pressure motor 75 in order to set up the optimal feed pressure while referencing the output of the feed pressure sensor 36. Also, the controller 50 drives the separation pressure motor 7 in order to set up the optimal separation pressure while referencing the output of the separation pressure position sensor group 8. Further, the controller 50 drives the jump board angle motor 93 in order to set up the optimal jump board angle while referencing the output of the jump board angle sensor 37. In addition, the controller 50 drives the sheet feed motor 66 in order to set up the optimal amount of loop. In this manner, the optimal sheet feed conditions are automatically set up in accordance with the kind of sheets 56 manually selected.

The contents of FIG. 12 will be described more specifically. Temperature (° C.) and humidity (RH %) are related to the sheet separating and feeding ability, as stated earlier. Generally, for standard sheets and rough sheets, the separator pad 1 with the standard pad 1*a* having a relatively great coefficient of friction is selected because overlap feed is apt to occur with such sheets. For thin sheets, thick sheets and special sheets (envelopes), the separator pad 2 with the special pad 2*a* having a relatively small coefficient of friction is selected because thin sheets are likely to crease and fail to be fed and because thick sheets and special sheets are likely to peel, although overlap feed is rare with such sheets. Of course, part of rough sheets is rarely subjected to overlap feed and low in rigidity and must be dealt with in the same manner as thin sheets.

Generally, when the separator pad is raised, i.e., when the pad angle relative to the horizontal plane is increased in FIG. 2B, the overlap feed preventing effect is enhanced, but the load to act on the separation and conveyance of a sheet tends to increase. Conversely, when the pad angle relative to the horizontal plane is reduced in FIG. 2B, overlap feed is likely to occur. In light of this, medium to large pad angles ranging from 20° to 22° are selected for standard sheets and rough sheets in order to obviate overlap feed. On the other hand, small to medium pad angles ranging from 18° to 20° are selected for thin sheets, thick sheets and special sheets in order to guarantee conveyance by minimizing the above load while reducing overlap feed. It should be noted that the pad angle is varied over the range of from 10° to 35°, depending on the material of the pad.

Numerical values representative of feed pressures and separation pressures are substitute values set in accordance with the size of the actual feed pressure and separation pressure (gf/cm$^2$) the pressures increase with the increase of the numerical value. Generally, in the standard environment (temperature of 23° C. and humidity of 65 RH %), the feed pressure causes feed failure to occur if excessively low or brings about overlap feed if excessively high while the separation pressure causes feed failure to occur if excessively high or brings about overlap feed if excessively low. These relations are also taken into account in setting the pressures of FIG. 12 based on experimental results.

The jump board angle is a substitute representative of the angle of the jump boards and may be either one of two angles "up" and "down" shown in FIG. 12. For standard sheets, the jump board angle must be increased (up) for providing the sheet 56 with a certain degree of rigidity before discharging it. This is also true with rough sheets and thin sheets. For thick sheets and special sheets (envelopes), the jump board angle must be reduced (down) because the sheet 56 itself has certain rigidity or cannot be provided with rigidity.

The amount of loop refers to the amount of feed of the sheet 56 to be effected after the leading edge sensor 83 preceding the registration rollers 81 and 82 has sensed the leading edge of the sheets 56. After the leading edge of the sheet 56 has abutted against a position just ahead of the nip between the rollers 81 and 82, the sheet 56 is fed by the above amount in order to maintain a preselected amount of loop. Numerical values listed in FIG. 12 each refer to the number of pulses sent to the sheet feed drive motor 66; the amount of loop increases with the increase of the number of pulses. The amount of loop may be set in terms of the amount of feed of the pick-up roller 62 or that of the separation roller 63 without resorting to the leading edge sensor 83.

As stated above, in the illustrative embodiment, the feed pressure, separation pressure, jump board angle and amount of loop are set in accordance with the kind and angle of the automatically switched separator pad as optimal sheet feed condition data and variably control led, as shown in FIG. 12. For more delicate control, there may be additionally controlled the amount of rotation of the separator roller 63, paying attention to the slip of the roller 53 relating to the kind of the sheet 56, or the intensity of an air stream to be output from the air blower 84, paying attention to the roll-up of the sheet 56 relating to the kind of the sheet 56.

Hereinafter will be described a specific sheet selecting and setting procedure and a paper conveying and printing operation. Assume that temperature and humidity are 23° C. and RH 65% (standard environment), respectively, that the sheets 56 used last time are standard sheets, and that the pad currently selected is the standard pad 1. Under these conditions, it will be seen from FIG. 12 that the feed pressure is "3", the separation pressure is "2", the jump board angle is "up", and the amount of loop is "28".

When the operator turns on the power switch and then the kind-of-sheet key 119 in the above environment, the picture of FIG. 9 appears on the LCD 114 including a message "Input the kind of sheets." Usually, "Standard" is highlighted as the kind of sheets 56. When the operator desires to use, e.g., drawing paper (thick sheets) as the sheets 56, the operator shifts the highlighted portion to "Thick" by pressing the "→" key 118 or the key 123*a* included in the scroll keys 123 and then enters it on the set key 116. As a result, a message "Ex. high quality paper above 135 kg, drawing paper, postcard or similar thick paper" appears in the lower portion of the LCD 114. This allows the operator to confirm that drawing paper belongs to the class of "Thick" sheets and enter "Thick" immediately.

When "Thick" is selected by the operator, the controller 50 selects "special" (separator pad 2) as the kind of an optimal pad in accordance with the sheet feed condition data of FIG. 12, i.e., temperature ranging from 16° to 25°, humidity of 51% or above, and "Thick" selected by the operator as the kind of sheets 56. In addition, the controller 50 selects an optimal pad angle of 18° for the separator pad 2. Subsequently, the controller 50 so controls the pad motor 23 as to automatically replace the separator pad 1 (standard) with the separator pad 2 (special) by referencing the outputs of the pad sensors 41, switching sensors 25 and 26, temperature sensor 38, and humidity sensor 39. Further, the controller 50 so controls the angle motor 14 as to automatically replace the pad angle of 22° assigned to the separator pad 1 with the pad angle of 18° optimal for the separator pad 2 by referencing the outputs of the angle sensor group 17, temperature sensor 38, and humidity sensor 39.

When the controller 50 replaces the separator pad 1 (standard) with the separator pad 2 (special), it controls the separation pressure motor 7 to cancel the separation pressure, i.e., to lower the pads 1*a* and 2*a* away from the rectangular holes 30*a* of the front wall 30. This insures smooth switching while protecting the pads 1*a* and 2*a* and separator roller 63 from damage.

The controller 50 automatically selects, based on the special pad 2 and optimal pad angle of 18°, more minute optimal sheet feed conditions which are the feed pressure of "3", separation pressure of "1", jump board angle "up", and amount of loop "21". To set up the above feed pressure, the controller 50 controls the feed pressure motor 75 by referencing the output of the feed pressure position sensor 36. To set up the above separation pressure, the controller 50 controls the separation pressure motor 7 by referencing the output of the separation pressure position sensor group 8. Further, to set up the above jump board angle, the controller 50 controls the angle motor 93 by referencing the output of the angle sensor 37. In addition, to set up the above amount of loop, the controller 50 controls the sheet feed motor 66. Consequently, the optimal sheet feed conditions are automatically set up in accordance with the kind of the sheets 56 selected by the operator.

Before or after the above sheet selection, the operator presses the start key 111. In response, the document reading operation of the document scanning section 210 and the conventional master making and used master discharging operation occur in parallel. As a result, a new master 53 is wrapped around the print drum 51.

Also, before or after the sheet selection, the operator stacks the sheets (drawing paper in this cases) 56 on the tray 54 located at its lower limit position, as determined by the lower limit sensor 94. The operator then inputs a desired number of prints on the numeral keys 113 and then presses the print key 112. In response, the controller 50 drives the tray motor 59 in order to lift the tray 54. When the top of the sheet stack 56 on the tray 54 contacts the pickup roller 62 and then pushes it up, the arm 68 is also raised. The arm 68 presses the feeler 71*a* of the upper limit sensor 71 and thereby turns on the sensor 71. In response to the resulting output of the upper limit sensor 71, the controller 50 stops driving the tray motor 59 and locates the tray 54 at a preselected level or sheet feed position necessary for printing. Thereafter, printing in a print mode occurs. If the operator's recognition that drawing paper belongs to the "Thick" class is objectively correct, then the first print and successive prints will be output under the previously stated optimal sheet feed conditions.

Subsequently, the print drum 51 starts rotating while the sheet feed motor 66 starts rotating the pickup roller 62. The pickup roller 62 pays out the top sheet 56 in the direction X. At the same time, the separator pad 2 and separator roller 63 cooperate to separate the top sheet 56 from the underlying sheets 56. The top sheet 56 is surely fed out without a jam ascribable to feed failure or overlap feed because of the optimal sheet feed conditions (feed pressure of "3" and separation pressure of "1").

When several sheets 56 are fed from the tray 54, the pickup roller 62 and therefore arm 68 is lowered. When the upper limit sensor 71 turns off due to the lowering of the arm 68, the controller 50 drives the tray motor 59 in response to the resulting output of the sensor 71. As a result, the tray 54 is again raised until the upper limit sensor 71 turns on. In this manner, the tray motor 59 is selectively turned on or turned off in accordance with the ON/OFF of the upper limit sensor 71, intermittently raising the tray 54 to the sheet feed position.

When the leading edge of the sheet 56 paid out by the pickup roller 63 abuts against a position just short of the nip between the registration rollers 81 and 82, the sheet 56 forms a loop of the amount of "21" corresponding to the number of pulses sent to the sheet feed motor 66. Subsequently, the registration rollers 81 and 82 rotate in synchronism with the rotation of the print drum 51, driving the sheet 56 at a preselected timing. The sheet or print 56 on which an image is printed at the nip between the print drum 51 and the press roller 80 is driven out to the tray 87. At this instant, the jump board angle "down" which is one of the optimal sheet feed conditions provides the sheet 56 with an adequate degree of rigidity (not effected with "Thick" sheets), so that the sheet 56 is neatly stacked on the tray 87. Every time the print drum 51 makes one rotation, a single sheet or print 56 is fed without a jam or similar trouble in conveyance, then printed with an image, and then discharged without a jam or similar trouble in conveyance. The above procedure is executed with a stencil printer not needing a printing step for adhering a master to the print drum 51. A stencil printer needing such a step will produce a single print when the start key 111 is pressed, causing the master 53 to closely adhere to the print drum 51 due to the adhesion of ink.

Assume that the over lap feed sensor 43 senses over lap feed more than a preselected number of times while the above printing operation is repeated. Then, the controller 50 controls the pad motor 23 in order to automatically replace the separator pad 1 or 2 with a new pad 1 or 2. In addition, the controller 50 controls the angle motor 14 for automatically selecting a preselected angle of the pad 1 or 2 matching with the frequency of overlap feed. At this instant, the controller 50 causes, e.g., a message "No spare pads; prepare new pads." to appear on the LCD 114, urging the operator to given an order for new pads. This successfully prevents the printer 200 from being killed over a long period of time due to the absence of new pads.

Figure 13:
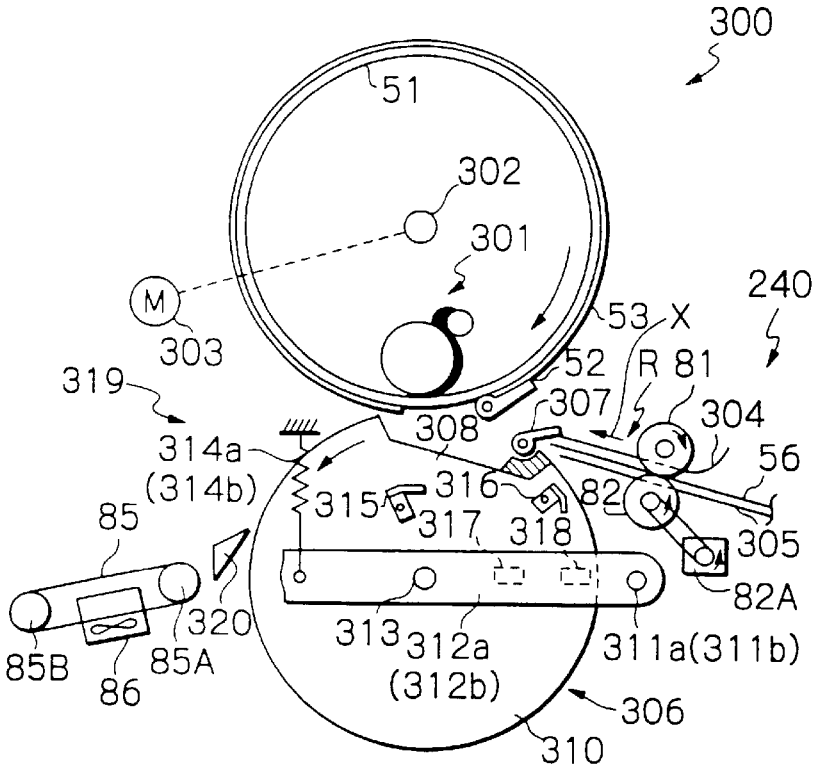
FIG. 13 is a fragmentary front view showing an alternative embodiment of the present invention.
Figure 14:
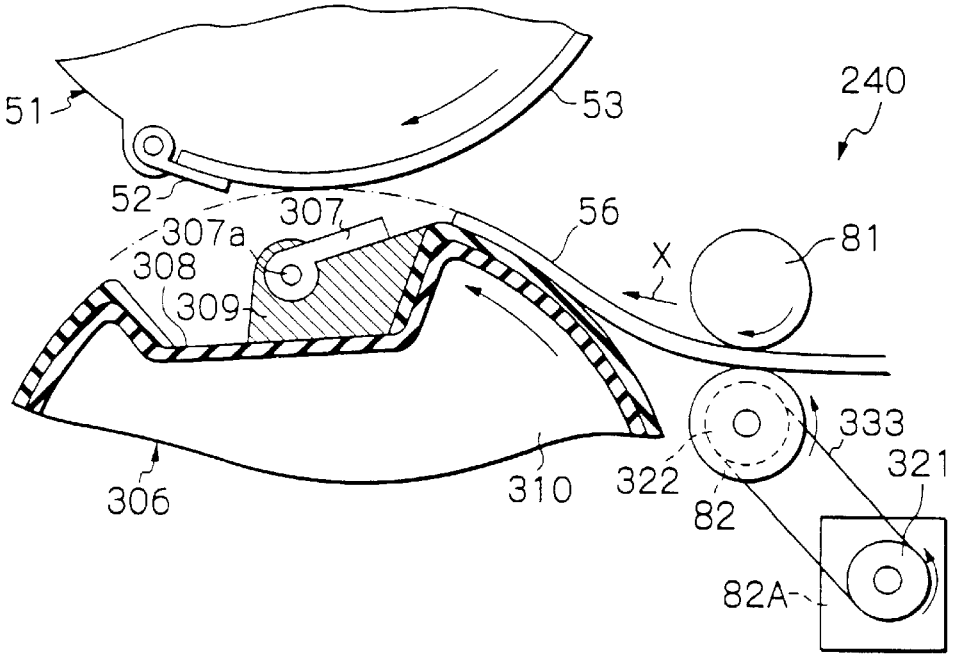
FIG. 14 is a fragmentary section for describing how a sheet damper included in the alternative embodiment selectively clamps a sheet and the resulting sheet conveying operation.

Referring to FIGS. 13, 14 and 15, an alternative embodiment of the present invention will be described. As shown, a stencil printer, generally 300, includes a conventional press drum 306 in place of the press roller or pressing means 80 of the stencil printer 200. The press drum 306 has a sheet damper or clamping means 307 for clamping the leading edge of the sheet 56. In this embodiment, the controller 50 additionally controls the timing for the registration rollers 81 and 82 to convey the leading edge of the sheet 56 and the sheet conveying speed. As for the rest of the construction, the stencil printer 300 is essentially similar to the stencil printer 200.

The press drum 306 with the sheet damper 307 has substantially the same outside diameter as the print drum 51. The press drum 306 rotates at substantially the same peripheral speed as, but in the opposite direction to, the print drum 51 while clamping the leading edge portion of the sheet 56 over 2 mm to 5 mm and forcibly peels off the leading edge portion from the print drum 51. With the press drum 306, it is possible to prevent the leading edge of the sheet 56 from remaining on the print drum 51 and rolling up without being peeled off by an air blower (air knife) and/or a peeler not shown in FIG. 13. It is also possible to reduce noise and to enhance the positional accuracy (registration accuracy) of an image in the direction X in which the sheet 56 is conveyed.

Clamping the leading edge portion of the sheet 56 obviates the following occurrence. So long as the sheet 56 is a relatively thin standard sheet, the sheet damper 307 can easily clamp it. However, because the sheet damper 307 has a layout shown in FIG. 14 in an exaggerated form, the clamper 307 cannot bend the leading edge portion of drawing paper, postcard or similar thick sheet inward or clamp it without resorting to a great clamping force. Then, the sheet damper 307 fails to fully close its end portion and causes it spaced above the periphery of the press drum 306 (indicated by a dash-and-dots line in FIG. 14) to hit against the master 53 wrapped around the print drum 51. The end of the sheet damper 307 repeatedly hits against the same portion of the master 53 everytime the press drum 306 rotates, causing the above portion of the master 53 to break. Consequently, the ink fed to the outer periphery of the print drum 51 is forced out through the broken portion of the master 53 and smears the sheet damper 307 and therefore the leading edge portion of the sheet 56. Moreover, because such a master 53 is pulled to the upstream side in the direction of rotation of the ink drum 51 at each time of printing, it tears at the broken portion and is shifted to the upstream side in the above direction.

A main motor 303, not shown in FIG. 1, causes the print drum 51 to rotate in a direction indicated by an arrow in FIGS. 13 and 14. The main motor 202, implemented by a DC motor by way of example, does not have to transfer its rotation to the sheet feed driveline and is therefore smaller in size than the conventional main motor. The main motor 303 drives the press drum 306 via a drive transmission mechanism, not shown, in addition to the print drum 51. An ink feeding device 301 is arranged in the print drum 51 and includes an ink roller and a doctor roller not shown in FIG. 1.

A recess 308 is formed in the periphery of the press drum 306 in order to prevent the sheet damper 307 from contacting the damper 52 of the print drum 51. Specifically, the sheet damper 307 and a damper base 309 are disposed in the recess 308. The sheet damper 307 is operably mounted on the damper base 309 via a shaft 307*a*. A spring, not shown, constantly biases the sheet damper 307 toward a closed position. A cam, not shown, mounted on the printer body causes the sheet damper 307 to open at a preselected timing, clamp the leading edge of the sheet 56, and then close to retain the sheet 56 on the press drum 306.

The press drum 306 identical in outside diameter with the print drum 51 accurately makes one rotation when the print drum 51 makes one rotation, causing the recess 308 to face the damper 52. This allows the sheet damper 307 to be mounted on the press drum 306 for clamping the leading edge of the sheet 56, as shown in FIG. 13. By feeding the sheet 56 while causing its leading edge to abut against the sheet damper 307, it is possible to increase the registration accuracy of the sheet 56. More specifically, after the leading edge of the sheet 56 has abutted against the sheet damper 307 held at a position shown in FIG. 13 (sheet clamp position), the damper 307 is closed to clamp the leading edge. Subsequently, the sheet damper 307 is sequentially moved counterclockwise due to the rotation of the press drum 306. At a position just before a peeler 320 (sheet unclamp position), the sheet damper 307 is opened to release the leading edge of the sheet 56 at a position past of a press position where the ink is transferred to the sheet 56. As a result, the sheet 56 is prevented from rolling up together with the print drum 51 despite the viscosity of the ink.

A moving mechanism 319 causes the press drum 306 to selectively move into or out of contact with the outer periphery of the ink drum 51. The moving mechanism 319 includes a pair of arms 312*a* and 312*b* respectively rotatably supporting shafts 313 affixed to opposite ends of the press drum 306. The arms 312*a* and 312*b* are respectively rotatable about shafts 311*a* and 311*b* so as to angularly move the press drum 306. Cam followers, not shown, each are rotatably mounted on the other end of each arm 312*a* or 312*b*. A pair of springs 314*a* and 314*b* are respectively anchored to the arms 312*a* and 312*b* for constantly biasing the press drum 306 toward the print drum 51. A pair of print cams, not shown, respectively selectively contact the above cam followers.

The sheet feeding section 240 is located at the right-hand side of the press drum 306 as in the previous embodiment. A drive mechanism around the registration motor 82A, not shown in FIG. 1, will be described specifically. A drive pulley 321 is mounted on the output shaft of the registration motor 82A. A timing belt 333 is passed over the drive pulley 321 and a driven pulley 322 mounted on the shaft of the lower registration roller 82. In this configuration, the registration motor 82A causes the registration roller 82 to rotate counterclockwise via the timing belt 333.

As shown in FIG. 13, two screen plates 315 and 316 are fastened to a front end wall 310 forming part of the press drum 306 by screws. The screen plates 315 and 316 are spaced from each other by a preselected distance in each of the radial and circumferential directions of the press drum 306. Two transmission type photosensors 317 and 318 are fastened to the inner surface of the arm 312*a* by screws and spaced from each other by a preselected distance in the radial direction of the press drum 306.

The screen plate 315 blocks the optical path of the photosensor 317 when the press drum 306 is rotated counterclockwise to a preselected position. The screen plate 315 and photosensor 317 play the role of sheet feed timing sensing means for determining the timing for feeding the leading edge of the sheet 56 to the registration rollers 81 and 82.

The screen plate 316 blocks the optical path of the photosensor 318 when the press drum 306 is rotated counterclockwise to another preselected position. The screen plate 316 and photosensor 318 constitute timing sensing means for determining the timing for driving the leading edge of the sheet 56 toward the sheet clamper 307. In addition, the screen plate 316 and photosensor 318 play the role of rotation position sensing means for sensing the position of the sheet damper 307 in the circumferential direction of the press drum 306. Assume the distance on the sheet transport path between the nip between the registration rollers 81 and 82 and the position where the leading edge of the sheet 56 abuts against the sheet damper 307, and the circumferential distance between the angular position of the press drum 306 where the screen plate 316 meets the photosensor 318 and causes it to output an ON signal and the sheet damper 307 against which the sheet 56 is abutting. Then, the screen plate 316 is positioned on the end wall 310 such that the above two distances are equal to each other.

When the sheet 56 is a thick sheet, the controller 50 varies the timing for feeding the sheet 56 toward the sheet damper 307 such that the leading edge of the sheet 56 is fed to a position where it will not be clamped by the sheet damper 307, and such that the leading edge is shifted to the upstream side in the direction X relative to the sheet damper 307 by a preselected amount. More specifically, the controller 50 controls the registration motor 82A in response to the output of the photosensor 318 in such a manner as to delay the above sheet feed timing.

The master making section 220 includes a master conveying device including a platen roller, not shown, rotatable while pressing the master or stencil 53 against a conventional thermal head, not shown, and a pulse motor, not shown, for driving the platen roller. The thermal head has a number of heating elements. When the sheet 56 is a thick sheet, the controller 50 additionally controls the above pulse motor in such a manner as to delay the position where the thermal head starts making a master by the above delay of the sheet feed timing assigned to the registration motor 82A.

The above control over the master making section 220 and/or the open/close control over the sheet damper 307 is not essential. Alternatively, the registration motor 82A may be controlled at substantially the same timing and rotation speed as when a standard sheet is fed to the top of the damper 307 which is closed then or is constantly closed. This is also successful to obviate the previously stated occurrence.

For details of the sheet feed control relating to the use of the press drum 306, reference may be made to Japanese Patent Laid-Open Publication No. 10-149091.

Specifically, the controller 50 controls the pad motor 23 by referencing the outputs of the pad sensors 41, switching sensors 25 and 26, temperature sensor 38 and humidity sensor 39 in order to automatically select the separator pad 1 (standard) or 2 (special) having an optimal coefficient of friction (see FIG. 12). At the same time, the controller 50 controls the angle motor 14 in order to automatically set the optimal angle of the separator pad 1 or 2 by referencing the outputs of the angle sensor group 17, temperature sensor 38, and humidity sensor 39.

FIG. 15 lists specific sheet feed conditions identical with the conditions of FIG. 12 except for the addition of "Paper Clamp" which was also determined by experiments. The conditions shown in FIG. 15 are stored in the ROM of the controller 50 as sheet feed condition data beforehand. The "Paper Clamp" refers to whether or not the sheet damper 307 clamps the leading edge of the sheet 56 ("yes" and "no" referring to clamping and not clamping, respectively). The damper 307 clamps standard sheets, rough sheets and thin sheets belonging to a group of relatively thin sheets 56, but does not clamp thick sheets and special sheets belonging to a group of relatively thick sheets 56.

Another alternative embodiment of the present invention will be described hereinafter. This embodiment is identical with the embodiment described with reference to FIGS. 1 through 12 except for the following. The illustrative embodiment includes a plurality of (two in the embodiment) separator pads 1 having the same coefficient of friction in place of the separator pads 1 and 2 different in the coefficient of friction. In the illustrative embodiment, the controller or control means 50 controls the pad motor 23 such that when the print counter 47 counts a preselected number of prints, the separator pad 1 in operation is automatically replaced with a new separator pad 1.

Specifically, the two separator pads 1 are respectively set on the two pad holder guides 3 of the pad switching section C. Assume that the print counter 47 reaches a preselected count during the repeated paper passing and printing operation as in the embodiment of FIGS. 1 through 12. Then, the controller 50 drives the pad motor 23 to automatically replace the separator pad 1 in operation with a new or spare separator pad 1. At this time, the previously mentioned specific message "No spare pads; prepare new pads." appears on the LCD 114, urging the operator to give an order for new pads. This embodiment not only achieves the same advantage as the previous embodiment, but also achieves an advantage that the time for replacing the separator pad 1 is extended because the pad 1 in operation is automatically replaced with a spare pad 1 without resorting troublesome manual switching of the pads 1. It is to be noted that the controller 50 may execute the above control on the basis of the number of prints driven out to the tray 87, FIG. 1.

A modification of the embodiment shown in FIGS. 1 through 12 includes a kind-of-sheet sensor 45 (indicated by a dash-and-dots line in FIG. 11) in place of the kind-of-sheet setting means of the previous embodiment. The sensor 45 is capable of determining the kind of sheet 56. Specifically, the sensor 45 may be an optical sensor responsive to the intensity of a reflection from the sheet 56 representative of the thickness of the sheet or an electrical sensor responsive to a mechanical gap between rollers also representative of the thickness of the sheet 56.

In the above modification, the controller 50 controls, based on the output of the kind-of-sheet sensor 45, the pad motor 23 in order to automatically select the separator pad 1 or 2 in accordance with the kind of the sheets 56. At the same time, the controller 50 controls the angle motor 14 in order to automatically set up the optimal angle of the separator pad 1 or 2 matching with the kind of the sheets 56.

Another modification of the embodiment shown in FIGS. 1 through 12 is characterized in that it sets up more desirable sheet feed conditions by taking account not only of the quality of the sheets 56 including thickness and surface condition, but also of the size of the sheets 56. That is, in this modification, the kind of the sheets 56 includes the sheet size as well.

The kind of the sheets 56 is manually selected and set via the kind-of-sheet setting means or automatically sensed and set via the kind-of-sheet sensing means, as in the previous embodiment. Subsequently, while the LCD 114 is displaying the initial picture shown in FIG. 8, the operator presses the initial set key 122. As a result, the picture shown in FIG. 10 appears on the LCD 114 in place of the initial picture and shows a specific message "Input a sheet size." in its upper portion. Also, the picture of FIG. 10 shows three different classes of sheet size, i.e., A3 and B4, A4 and B5 and postcard on its second line from the top. This modification is capable of automatically selecting one of the three sheet sizes.

Specifically, this modification automatically senses the size of the sheets 56 with a sheet size sensing mechanism including the size sensor group 57A, FIGS. 7 and 11. Assume that the sheets 56 stacked on the tray 54 are standard sheets and have a size A3 or B4. Then, "A3, B4" included in the picture of FIG. 10 is highlighted to show that the sizes A3 and B4 are automatically selected. The operator watching the LCD 114 should only press the set key 116. In response, the controller 50 selects more desirable sheet feed conditions taking account of the sheet size as well, and so controls the various factors as to set up the more desirable sheet feed conditions. While such more desirable sheet feed conditions taking account of the sheet size are not shown specifically, they are stored in the ROM of the controller 50 in the same manner as the data listed in FIG. 12.

Generally, the more desirable sheet feed conditions taking account of the sheet size are selected in consideration of the following and determined by experiments. The sheet feed pressure is increased for the sheets 56of relatively great sizes A3 and B4 needing a great conveying force, but reduced for the sheets 56 of relatively small sizes A4 and B5 needing only a small conveying force. As for postcards, a feed pressure between the pressure assigned to A3 and B4 and the pressure assigned to A4 and B5 is selected, as indicated by experimental results.

The separation pressure is increased for the sheets 56 of relatively great sizes A3 and B4 in order to obviate overlap feed, but reduced for the sheets 56 of relatively small sizes A4 and B5. As for postcards, a separation pressure even lower than the pressure assigned to A4 and B5 (corresponding to a numerical value of 1), as indicated by experimental results.

The jump board angle must be increased for the sheets 56 of sizes A4 and B5 in order to provide the sheets 56 with a sufficient degree of rigidity. This is also true with the sheets 56 of sizes A3 and B4. However, the jump board angle must be reduced for postcards because postcards themselves have rigidity or cannot be provided with rigidity.

The above automatic sheet size sensing using the sheet size sensing mechanism including the sensor group 57A is not essential. Alternatively, the operator may select and set a sheet size on the initial set key 122, scroll keys 123 and select key group 115 (set key 116, "←" key and "→" key) constituting the sheet size setting means. For example, when the operator stacks the sheets 56 of size A4 or B5 on the tray 54, "A3, B4" is initially highlighted to indicate the sheet size. In this condition, the operator may shift the highlighted portion by using the key 117 or 118 or the key 123*c* or 123*a* and then enter it on the set key 116.

If the above control taking account of more minute sheet feed conditions is not necessary, the kind-of-sheet setting means and kind-of-sheet sensing means may be rep laced with the setting of sheet feed conditions considering a difference in sheet size only. Again, the kind of the sheets 56 includes the sheet size. In this case, the operator does not set the kind of the sheets 56, but presses the initial set key 122 in the condition shown in FIG. 8 in order to select a sheet size in the previously stated manner, or the sheet size sensing mechanism including the size sensor group 57A automatically senses the sheet size.

The foregoing description has concentrated on the problems relating to separating members implemented as separator pads. A system including a plurality of separator rollers or similar sheet separating means and a plurality of pickup rollers or similar sheet feeding means, automatically switching them in accordance with the kind of sheets and environmental conditions and automatically setting optimal sheet feeding means also lies in the scope of the present invention.

In summary, it will be seen that the present invention provides a sheet feeding device for an image forming apparatus having various unprecedented advantages, as enumerated below.

(1) A particular separating member and a particular angle of the separating member can be automatically selected. This makes it needless for the operator to change sheet feed conditions by relying on experiences. Optimal sheet feed conditions are automatically selected and insure stable sheet feed.

(2) A particular separating member and a particular angle of the separating member can be automatically selected in accordance with the kind of sheets to be used. This also frees the operator from troublesome manual setting and insures stable sheet feed under optimal sheet feed conditions.

(3) A particular separating member and a particular angle of the separating member can be automatically selected in accordance with temperature, humidity and other environmental conditions. This also frees the operator from troublesome manual setting and insures stable sheet feed under optimal sheet feed conditions.

(4) A separating member in operation can be automatically replaced with a spare separating member. This frees the operator from manual replacement and extends the time for replacement.

(5) Inadequate separation conditions ascribable to the wear of the separating member are obviated which would lead to defective sheet feed.

(6) The separating member and, e.g., a separator roller cooperating to generate a separation pressure are protected from damage due to the contact condition thereof.

(7) The time for giving an order for new separating members can be accurately determined. It is therefore possible to surely obviate the waste of time ascribable to the absence of separating members and to prevent the apparatus from being killed over a long period of time.

(8) A separation pressure can be automatically selected and set up as an optimal sheet feed condition. This further promotes stable sheet feed.

(9) A feed pressure and an amount of feed can be automatically selected and set up as optimal sheet feed conditions, further promoting stable sheet feed.

(10) It is not necessary for the operator to manually set the kind of sheets to be used. The kind of sheets can therefore be surely determined without any troublesome operation or errors ascribable thereto.

(11) The operator is allowed to set the kind of sheets to be used.

(12) It is not necessary for the operator to manually set a sheet size. Optimal sheet feed conditions can therefore be automatically switched without any troublesome operation or errors ascribable thereto.

(13) The operator is allowed to set a sheet size. Optimal sheet feed conditions can therefore be automatically switched.

(14) The device is most advantageous from the structure and cost standpoint.

Various modifications will become possible for those skilled in the art after receiving the teachings of the present disclosure without departing from the scope thereof.

What is claimed is:

1. A sheet feeding device for an image forming apparatus, comprising:

a plurality of separating members for separating sheets one by one; and an automatic separation angle switching mechanism for automatically switching an angle of said plurality of separating members, wherein said plurality of separating members are alternately selected to separate the sheets.

2. A device as claimed in claim 1, wherein said automatic separation angle switching mechanism includes drive means for driving said automatic separation angle switching mechanism, said device further comprising control means for automatically selecting a preselected angle of said plurality of separating members matching with a kind of the sheets.

3. A device as claimed in claim 1, further comprising overlap feed sensing means for sensing an overlap feed of the sheets, said control means so controlling, when said overlap feed sensing means senses the over lap more than a preselected number of times, said drive means as to automatically select a preselected angle of said plurality of separating members matching with a frequency of overlap feed.

4. A device as claimed in claim 1, further comprising:

a separation pressure adjusting mechanism including separation pressure variation drive means; and separation pressure control means for automatically selecting a preselected separation pressure matching with an angle of said plurality of separating members automatically selected, and so controlling said separation pressure variation drive means as to set up said preselected separation pressure.

5. A device as claimed in claim 2, further comprising sheet feed condition control means for automatically selecting and setting up preselected sheet feed conditions, including a feed pressure and an amount of feed, matching with an angle of one of said plurality of separating members automatically selected.

6. A device as claimed in claim 1, wherein said automatic angle switching mechanism includes drive means for driving said automatic angle switching mechanism, said device further comprising control means for so controlling said drive means as to automatically select a preselected angle of one of said plurality of separating members automatically selected in accordance with environmental conditions including temperature and humidity.

7. A sheet feeding device for an image forming apparatus, comprising:

a plurality of separating members having a same coefficient of friction with respect to sheets for separating said sheets one by one:

an automatic separating member switching mechanism including drive means for automatically replacing said plurality of separating members;

counting means for counting the sheets fed; and control means for so controlling, when said counting means counts a preselected number of sheets, said drive means as to automatically replace one separating member in use with another separating member.

8. A device as claimed in claim 7, further comprising display means for displaying, when one separating member in operation is replaced with another separating member which is a last spare separating member, a message showing that no spare separating members are available.

* * * * *

UNITED STATES PATENT AND TRADEMARK OFFICE

CERTIFICATE OF CORRECTION

PATENT NO. : 6,543,761 B2
DATED : April 8, 2003
INVENTOR(S) : Kenji Endo

It is certified that error appears in the above-identified patent and that said Letters Patent is hereby corrected as shown below:

Column 2,
Line 55, change “930714” to -- 9-30714 --.

Column 4,
Lines 19 and 66, change “damper” to -- clamper --.

Column 5,
Line 3, change “damper” to -- clamper --.

Column 10,
Line 53, change “Asia” to -- As a --.

Column 11,
Line 19, beginning at “it increases” through line 48, ending at “moving means”, move this entire 29-line section to Col. 10, line 57, after “FIG. 2B”.
Line 20, change “2a) when” to -- 2a); when --.

Column 12,
Line 57, change “directIly” to -- directly --.

Column 13,
Line 32, change “11” to -- 110 --.

Column 14,
Line 6, change “tube” to -- to be --.
Line 33, change “77” to -- ← --.

Column 15,
Line 29, change “19))” to -- 119)) --.

Column 18,
Line 46, change “control led,” to -- controlled, --.

Column 21,
Lines 3, 10, 25, 26, 31, 35, 40, 58, 59, 60, (two occurrences) and 61, change “damper” to -- clamper --.

UNITED STATES PATENT AND TRADEMARK OFFICE

CERTIFICATE OF CORRECTION

PATENT NO. : 6,543,761 B2
DATED : April 8, 2003
INVENTOR(S) : Kenji Endo

It is certified that error appears in the above-identified patent and that said Letters Patent is hereby corrected as shown below:

Column 21,
Line 61, change “operably” to -- openably --.
Lines 62 and 63, change “damper” to -- clamper --.
Line 65, change “damper” to -- clamper --.

Column 22,
Line 4, change “damper” to -- clamper -- (two occurrences).
Lines 8, 10, 12, 13 and 16, change “damper” to -- clamper --.

Column 23,
Lines 3, 7, 11, 15, 17, 19, 35, 39, 61 and 64, change “damper” to -- clamper --.

Column 25,
Line 19, change “56of” to -- 56 of --.
Line 53, change “rep laced” to -- replaced --.

Column 27,
Line 18, change “1” to -- 2 --.
Line 21, change “over lap” to -- overlap --.
Line 27, change “1” to -- 2 --.

Signed and Sealed this

Seventeenth Day of February, 2004

JON W. DUDAS
*Acting Director of the United States Patent and Trademark Office*